US011855398B2

(12) United States Patent
Qian et al.

(10) Patent No.: US 11,855,398 B2
(45) Date of Patent: Dec. 26, 2023

(54) MULTIPART CONNECTOR FOR CONVEYING POWER

(71) Applicant: Interplex Industries, Inc., East Providence, RI (US)

(72) Inventors: Yin Qian, Buffalo Grove, IL (US); Keith S. Maranto, Frankfort, IL (US); James M. Pick, Streamwood, IL (US); Richard Schneider, Livonia, MI (US)

(73) Assignee: Interplex Industries, Inc., East Providence, RI (US)

( * ) Notice: Subject to any disclaimer, the term of this patent is extended or adjusted under 35 U.S.C. 154(b) by 86 days.

(21) Appl. No.: 17/601,400

(22) PCT Filed: Apr. 14, 2020

(86) PCT No.: PCT/US2020/028123
§ 371 (c)(1),
(2) Date: Oct. 4, 2021

(87) PCT Pub. No.: WO2020/214595
PCT Pub. Date: Oct. 22, 2020

(65) Prior Publication Data

US 2022/0209433 A1 Jun. 30, 2022

Related U.S. Application Data

(60) Provisional application No. 62/836,173, filed on Apr. 19, 2019.

(51) Int. Cl.
*H01R 4/70* (2006.01)
*H01R 4/2429* (2018.01)
(Continued)

(52) U.S. Cl.
CPC ..... *H01R 4/2429* (2013.01); *H01R 4/70* (2013.01); *H01R 12/58* (2013.01);
(Continued)

(58) Field of Classification Search
CPC ..... H01R 4/2429; H01R 4/70; H01R 12/58; H01R 12/7088; H01R 13/113;
(Continued)

(56) References Cited

U.S. PATENT DOCUMENTS 3,740,510 A * 6/1973 Grunert ..... H01H 50/546 218/1
4,169,646 A 10/1979 Stape
(Continued)

FOREIGN PATENT DOCUMENTS

DE 102013013458 B3 10/2014
JP 2004-296197 A 10/2004
(Continued)

OTHER PUBLICATIONS

International Search Report for PCT/US2020/028123 dated Jul. 31, 2020.
(Continued)

*Primary Examiner* — Truc T Nguyen
(74) *Attorney, Agent, or Firm* — Katterle Nupp LLC; Paul Katterle; Robert Nupp

(57) ABSTRACT

A multipart connector for electrical connection to a conductor to convey AC power having a frequency greater than 60 Hz. The connector includes a plurality of metal plates. Each metal plate has opposing planar surfaces and includes a pair of legs separated by a space. A plurality of insulation layers adjoin the planar surfaces of the metal plates, respectively. The insulation layers include a pair of legs separated by a space. The metal plates and the insulation layers are arranged in a stack such that the spaces of the metal plates and the insulation layers are aligned to form a groove extending through the stack. The conductor is disposed in the groove.

20 Claims, 18 Drawing Sheets

(51) Int. Cl.

| | |
|---|---|
| ***H01R 12/58*** | (2011.01) |
| ***H01R 12/70*** | (2011.01) |
| ***H01R 13/11*** | (2006.01) |
| ***H01R 13/405*** | (2006.01) |

(52) U.S. Cl.
CPC ..... *H01R 12/7088* (2013.01); *H01R 13/113* (2013.01); *H01R 13/405* (2013.01)

(58) Field of Classification Search
CPC ..... H01R 13/405; H01R 12/585; H01R 13/6315; H01R 13/035
See application file for complete search history.

(56) References Cited

U.S. PATENT DOCUMENTS

| | | | | |
|---|---|---|---|---|
| 4,423,917 | A | 1/1984 | Scheingold | |
| 4,472,596 | A * | 9/1984 | Brown | H01R 4/2429 439/421 |
| 4,577,922 | A | 3/1986 | Stipanuk | |
| 4,662,702 | A | 5/1987 | Furuya | |
| 5,619,014 | A | 4/1997 | Faulkner | |
| 6,733,302 | B1 * | 5/2004 | Smalley, Jr. | H01R 12/7088 439/79 |
| 7,419,407 | B1 | 9/2008 | Jolly | |
| 9,431,721 | B2 | 8/2016 | Wimmer | |
| 9,972,957 | B1 | 5/2018 | Ang | |
| 10,522,945 | B2 | 12/2019 | Schneider | |
| 10,763,607 | B2 | 9/2020 | Schneider | |
| 10,784,623 | B2 | 9/2020 | Schneider | |
| 10,998,675 | B2 | 5/2021 | Lynch | |
| 11,362,444 | B2 | 6/2022 | Schneider | |
| 2002/0037666 | A1 * | 3/2002 | Kobayashi | H01R 4/2429 439/625 |
| 2017/0162984 | A1 * | 6/2017 | Liao | H01R 4/023 |
| 2018/0088179 | A1 * | 3/2018 | Ota | H05K 1/118 |
| 2019/0036284 | A1 | 1/2019 | Young | |
| 2019/0081439 | A1 | 3/2019 | Schneider | |
| 2021/0399480 | A1 * | 12/2021 | Song | H01R 13/6591 |

FOREIGN PATENT DOCUMENTS

| | | | |
|---|---|---|---|
| KR | 10-2001-0106381 | A | 11/2001 |
| WO | WO2018039123 | A1 | 3/2018 |

OTHER PUBLICATIONS

Written Opinion of ISA for PCT/US2020/028123 dated Jul. 31, 2020.

* cited by examiner

MULTIPART CONNECTOR FOR CONVEYING POWER

CROSS-REFERENCE TO RELATED APPLICATION(S)

This application is the U.S. national phase of PCT Application No. PCT/US2020/028123 filed on 14 Apr. 2020, which claims the benefit of priority under 35 U.S.C. § 119(e) to U.S. Provisional Patent Application No. 62/836,173 filed on 19 Apr. 2019, which is herein incorporated by reference.

TECHNICAL FIELD

The present disclosure relates to a multipart connector that is combined with a conductor to convey electric power.

BACKGROUND

In an electric/electronic system it is necessary to establish electrical connections between constituent parts of the system to convey power. To make these connections, connectors, such as couplers and terminals are often used. These connectors may be unitary, monolithic structures, or they may be formed from a plurality of constituent parts. The present disclosure is related to this latter type of connector in combination with a conductor.

BRIEF DESCRIPTION OF THE DRAWINGS

The features, aspects, and advantages of the present invention will become better understood with regard to the following description, appended claims, and accompanying drawings where:

DETAILED DESCRIPTION OF ILLUSTRATIVE EMBODIMENTS

Figure 1:
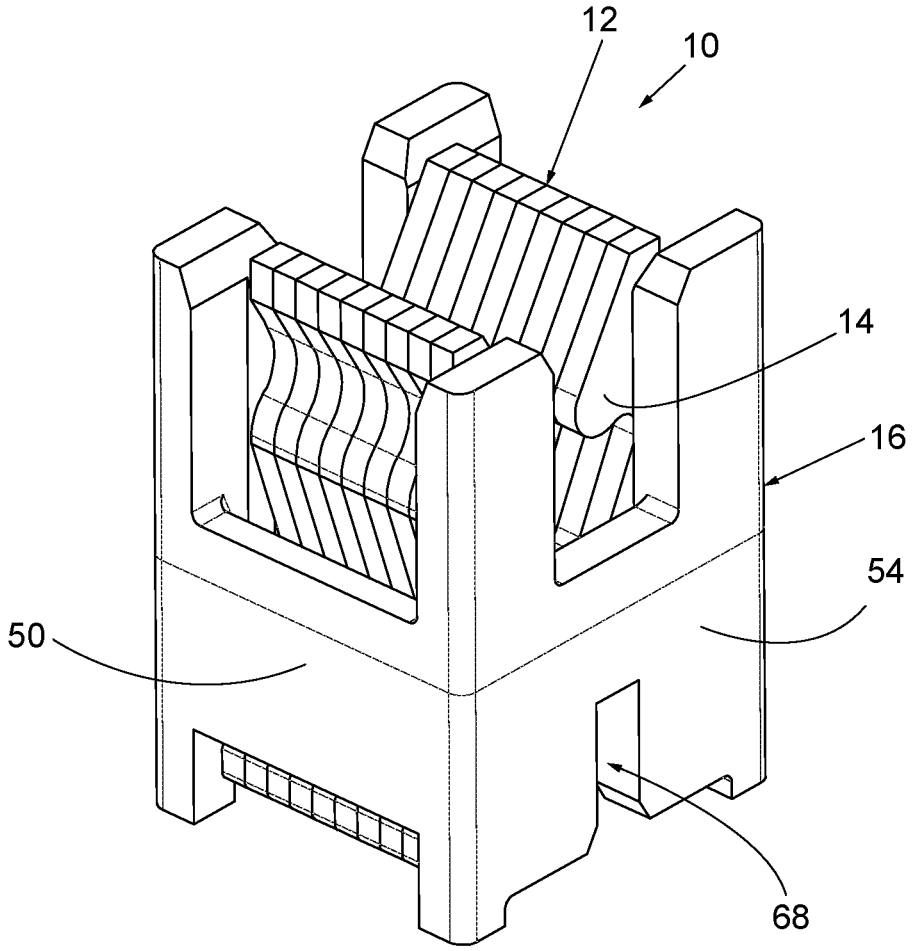
FIG. 1 shows a perspective view of a coupler of the disclosure.

It should be noted that in the detailed descriptions that follow, identical components have the same reference numerals, regardless of whether they are shown in different embodiments of the present disclosure. It should also be noted that for purposes of clarity and conciseness, the drawings may not necessarily be to scale and certain features of the disclosure may be shown in somewhat schematic form.

An electrical connector such as a terminal or a coupler may be provided with a construction that includes a plurality of metal plates that are stacked together to form a body that defines a groove for receiving an electrical conductor, whereby the connector and the conductor become physically and electrically connected together to convey electrical power. A coupler 10 having such a construction is shown in FIGS. 1-5, while terminals 120, 190 having such a construction are shown in FIGS. 6-14.

Figure 2:
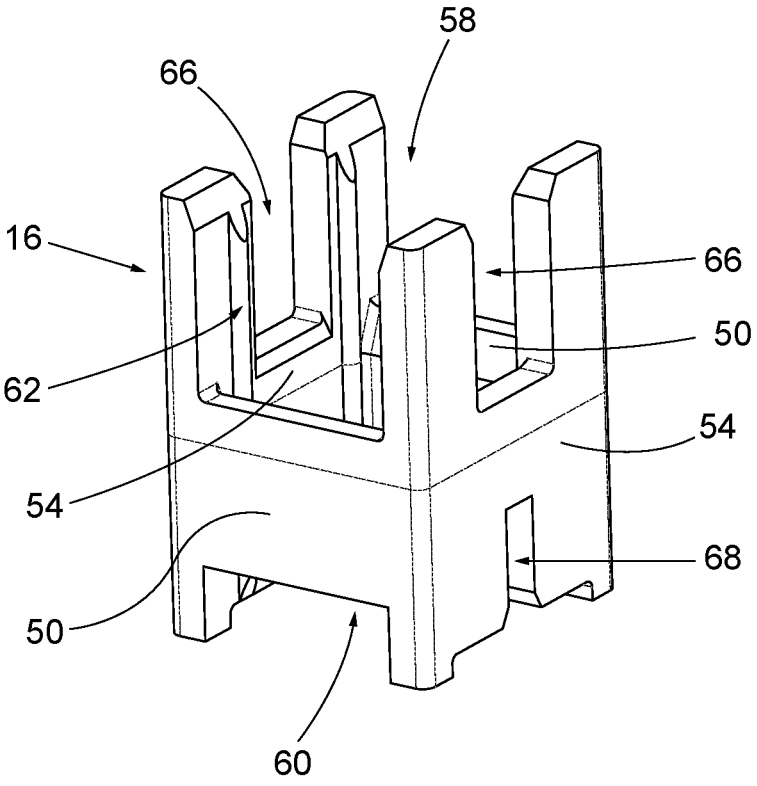
FIG. 2 shows a partially disassembled perspective view of the coupler with a stack of contact plates removed from a housing.
Figure 2:
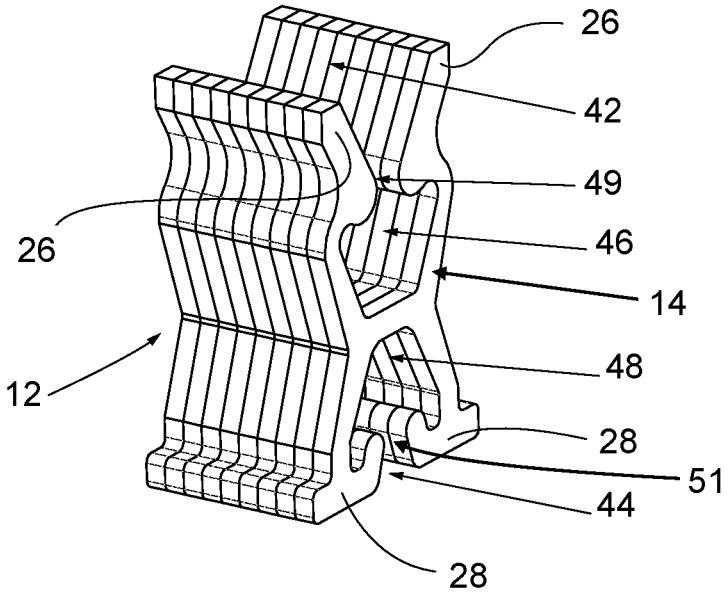
Figure 3:
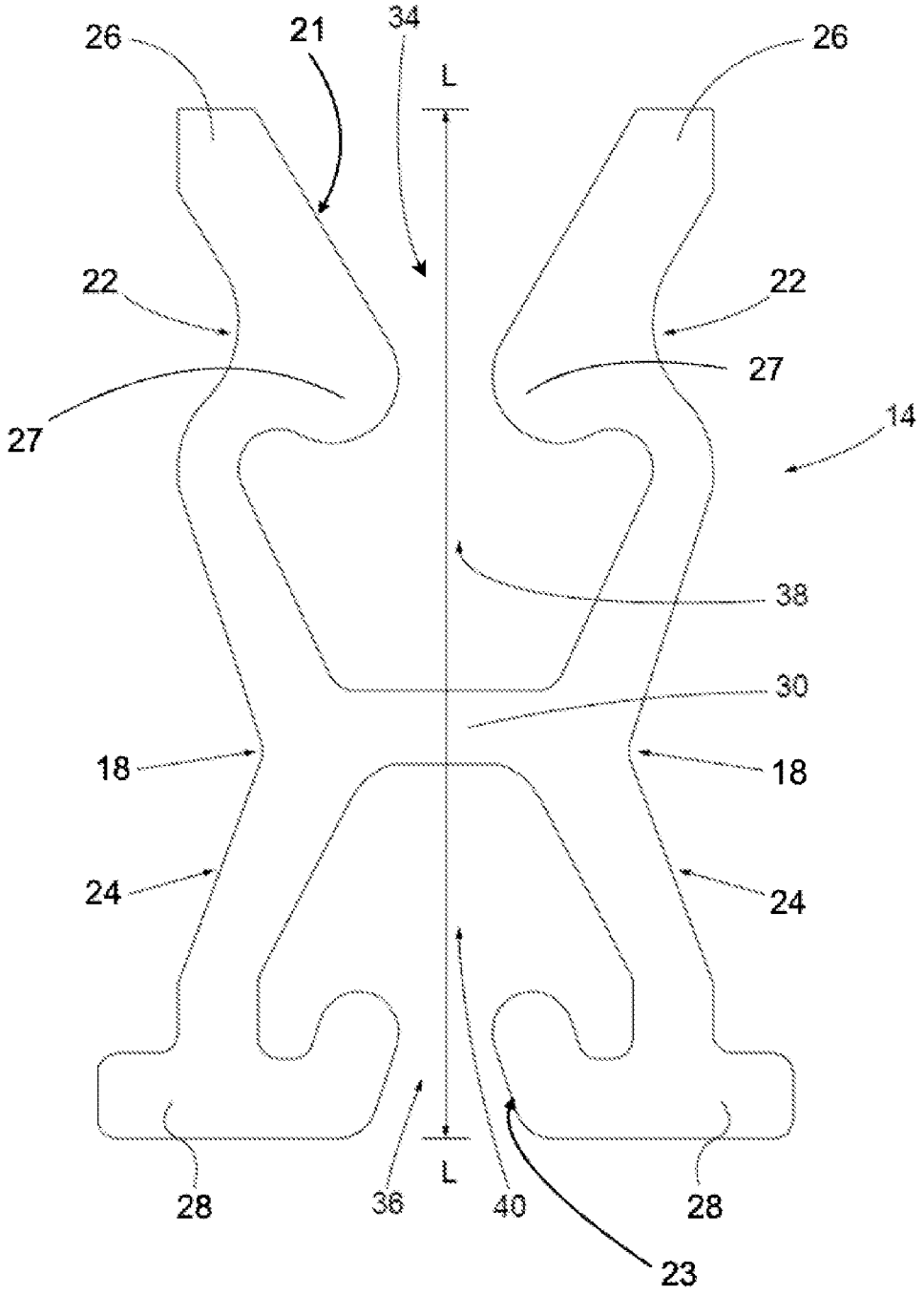
FIG. 3 shows a plan view of one of the contact plates.

Referring now to FIGS. 1-3, the coupler 10 includes a stack 12 of plates that comprise a plurality of contact plates 14. The stack 12 is disposed in a housing 16. Each of the contact plates 14 includes a support substrate 15 that is a unitary or monolithic structure that is electrically conductive. The support substrate 15 may be composed of a conductive metal, such as a tin plated copper alloy. The support substrates 15 may be formed by stamping one or more sheets of the conductive metal. In one or more embodiments, each contact plate 14 may further include one or more insulation coatings that are joined to the support substrate 15, as will be discussed in more detail below. In other embodiments, the stack 12 may include a plurality of separate insulation plates or webs that are interleaved with the contact plates 14 (consisting of the support substrates 15), also as described further below. In still other embodiments, the contact plates 14 (consisting of the support substrates 15) may be separated by air gaps. Even though the support substrates 15 may be separated by air gaps or insulation in some embodiments, the support substrates 15 in these embodiments are still electrically connected together to convey power, as described more fully below.

As best shown in FIG. 3, each contact plate 14 includes a pair of irregular-shaped elements or legs 18, each with an upper first portion 22 and a lower second portion 24. The first portion 22 includes a first end portion 26 with an inwardly-directed bulge 27, while the second portion 24 includes a second end portion 28 that extends laterally inward from an outer heel and then, towards the longitudinal center axis L, bends upward. The first end portions 26 have interior edges 21, respectively, and the second end portions 28 have interior edges 23. The legs 18 are joined together by a cross bar 30, intermediate the first and second end portions 26, 28. The cross bar 30 extends laterally between the legs 18 and helps give the contact plate 14 a general H-shape. The first end portions 26 define a first receiving space 34 therebetween, while the second end portions 28 define a second receiving space 36 therebetween. The first receiving space 34 adjoins a first inner space 38, while the second receiving space 36 adjoins a second inner space 40.

As shown best in FIG. 2, the contact plates 14 are stacked together, with their planar surfaces adjoining or being adjacent to each other, to form the stack 12. The contact plates 14 are aligned with each other such that the first receiving spaces 34 form a first receiving groove 42, the second receiving spaces 36 form a second receiving groove 44, the first inner spaces 38 form a first inner passage 46, and the second inner spaces 40 form a second inner passage 48. The first and second receiving grooves 42, 44 and the first and second inner passages 46, 48 extend in the stacking direction, which is normal to the planar surfaces of the contact plates 14. The narrowest portion of the first receiving groove 42 (which adjoins the first inner passage 46) is referred to as a contact zone 49. Similarly, the narrowest portion of the second receiving groove 44 (which adjoins the second inner passage 48) is referred to as a contact zone 51.

The housing 16 may be composed of an insulative material, such as plastic, and is generally cuboid in shape, with first and second open ends 58, 60. The housing 16 includes a pair of parallel, opposing first side walls 50 and a pair of parallel, opposing second side walls 54. The first side walls 50 each have a rectangular major opening 62 disposed toward the first open end 58. The second side walls 54 each have a rectangular major slot 66 disposed toward the first open end 58 and a rectangular minor slot 68 disposed toward the second open end 60.

The contact plates 14 are secured within the housing 16 in a press-fit operation in which the stack 12 as a whole is pressed into the housing 16 through the second open end 60 of the housing 16. The resulting interference fit between the stack 12 and the housing 16 secures the contact plates 14 within the housing 16, but permits pivoting motion of the contact plates 14, as described below. The contact plates 14 are disposed within the housing 16 such that the first receiving spaces 34 of the contact plates 14 are aligned with the first open end 58 of the housing 16 and the second receiving spaces 36 of the contact plates 14 are aligned with the second open end 60 of the housing 16. In addition, the first receiving groove 42 of the stack 12 is aligned with the major slots 66 in the housing 16 and the second receiving groove 44 of the stack 12 is aligned with the minor slots 68 in the housing 16.

Figure 4:
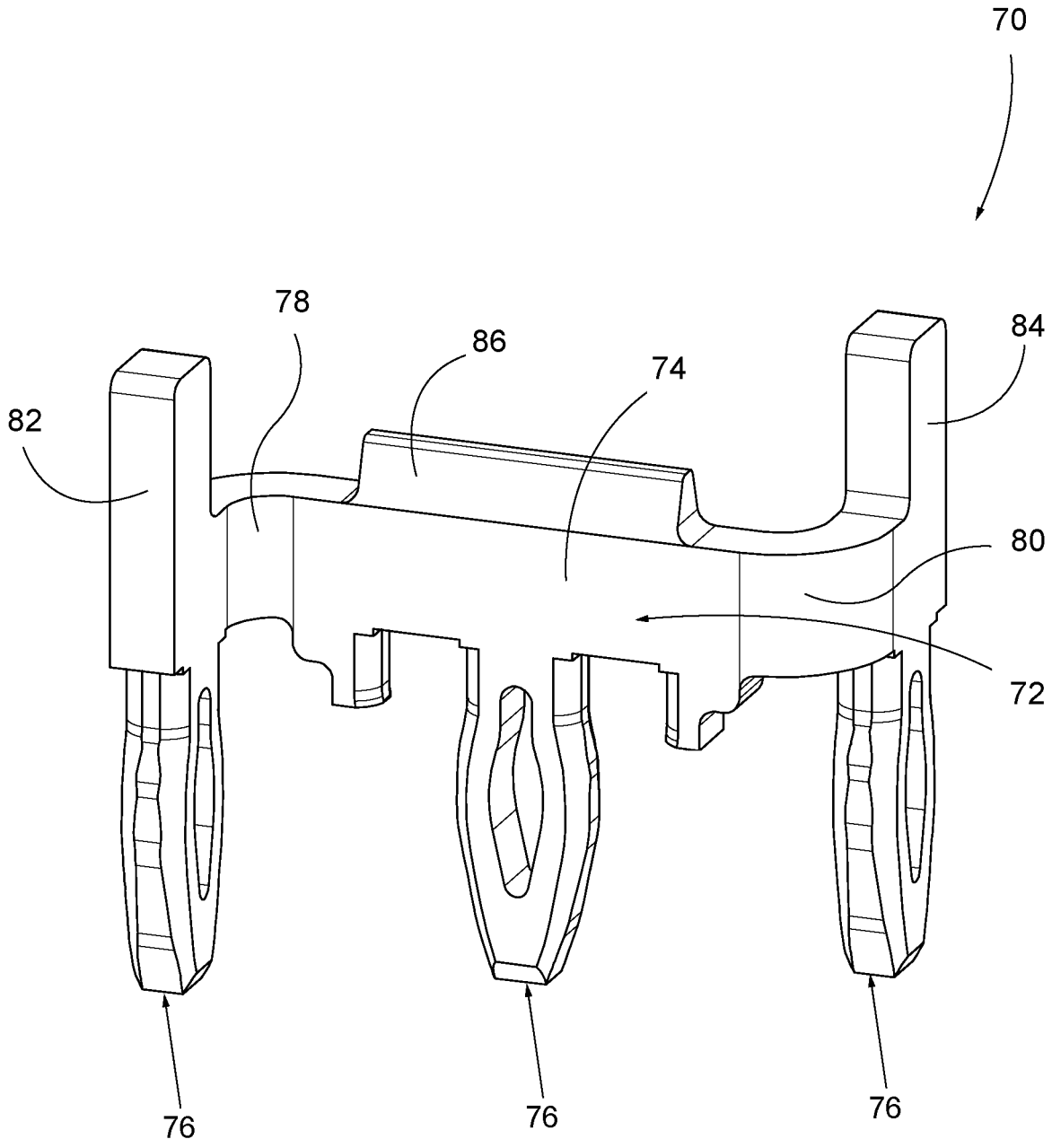
FIG. 4 shows a perspective view of a mounting contact for connection to the coupler.
Figure 5:
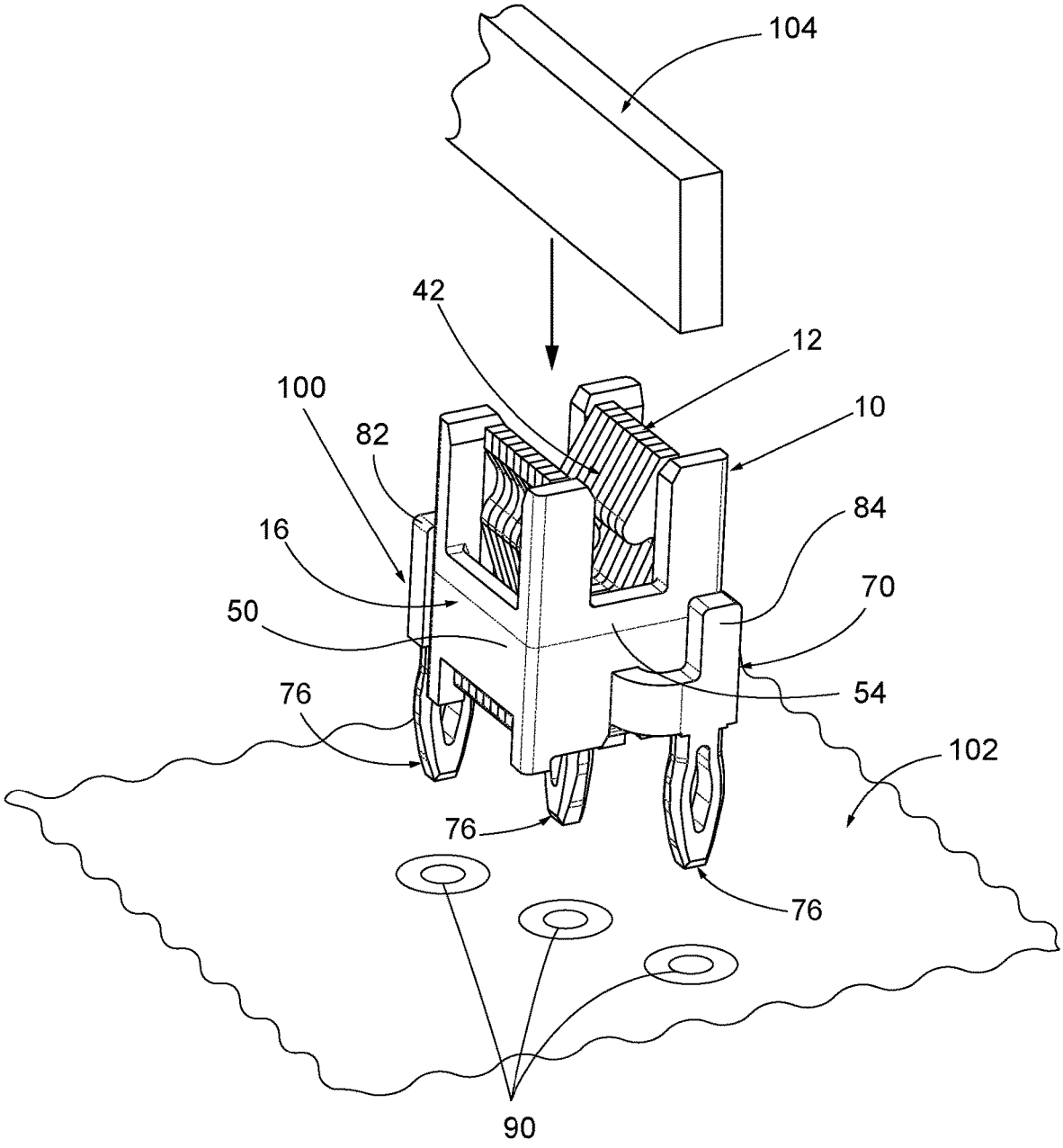
FIG. 5 shows a perspective view of the mounting contact of FIG. 4 connected to the coupler of FIG. 1 to form a connector, which is disposed between a bus bar and a printed circuit board.

Referring now to FIGS. 4 and 5, the coupler 10 may be engaged with a mounting contact 70 to form a connector 100 that is used to connect a PCB 102 to a bus bar 104. The mounting contact 70 is a monolithic, generally Z-shaped structure and is electrically conductive, being composed of a conductive metal, such as a tin plated copper alloy. The mounting contact 70 has a bar section 72 with fastening structures 76 extending outwardly therefrom. Each fastening structure 76 may have an EON type of press-fit construction. The bar section 72 includes a center beam 74 having opposing ends joined by bends 78,80 to arms 82, 84, respectively. The bends 78,80 curve in opposing directions to give the mounting contact 70 its Z-shape. A blade 86 is joined to an upper portion of the beam 74 and has beveled surfaces that form an elongated edge.

The mounting contact 70 is mounted to the coupler 10 (to form the connector 100) by inserting the beam 74 into the second receiving groove 44 and the second inner passage 48 of the coupler 10. Inside the contact zone 51, the interior edges 23 of the contact plates 14 engage planar surfaces of the beam 74 to make physical and electrical contact therewith. With the beam 74 so positioned within the coupler 10, the arms 82, 84 are disposed against the second side walls 54 of the coupler 10, respectively. The connector 100 is mounted to the PCB 102 by press-fitting the fastening structures 76 of the mounting contact 70 into plated holes 90 of the PCB 102.

From the foregoing description, it is clear that both the bus bar 104 and the mounting contact 70 electrically connect together the contact plates 14. The bus bar 104 may act as current distributor to provide electrical current to the contact plates 14, while the mounting contact 79 may act as a current collector for current flowing through the contact plates 14. In this manner, the contact plates 14 electrically connect the bus bar 104 to the PCB 102 to permit power to be conveyed from the bus bar 104 to circuits within the PCB 102.

The bar 104 (with its long edge disposed parallel to the PCB 102) may be inserted into the first receiving groove 42 of the coupler 10 to make physical and electrical connect between the bar 104 and the PCB 102. If the bar 104 is offset from longitudinal center axes of the contact plates 14 as it is being lowered into the first receiving groove 42, the coupler 10 will accommodate the misalignment. As the offset bar 104 moves into the first receiving groove 42, the bar 104 will contact the first end portions 26 of the contact plates 14, thereby causing the contact plates 14 to pivot about the center beam 74 of the mounting contact and guide the bar 104 into the narrow contact zone 49 between the interior edges 21 of the first end portions 26 of the contact plates 14. Inside the contact zone 49, the interior edges 21 of the contact plates 14 engage the planar surfaces of the bar 104 to make physical and electrical contact therewith. A major opening 62 in one the first side walls 50 permits this pivoting by receiving the first end portions 26 of the legs 18 of the contact plates 14. Even though the contact plates 14 have pivoted out of their normal position, they still maintain a good physical and electrical connection with the bar 104, thereby establishing a good physical and electrical connection between the PCB 102 and the bar 104. The structure of the mounting contact 70, with its offset arrangement of the fastening structures 76 helps prevent the connector 100 from pivoting and otherwise moving due to torsional and other forces applied by the bar 104 as it is being connected to the coupler 10.

Figure 6:
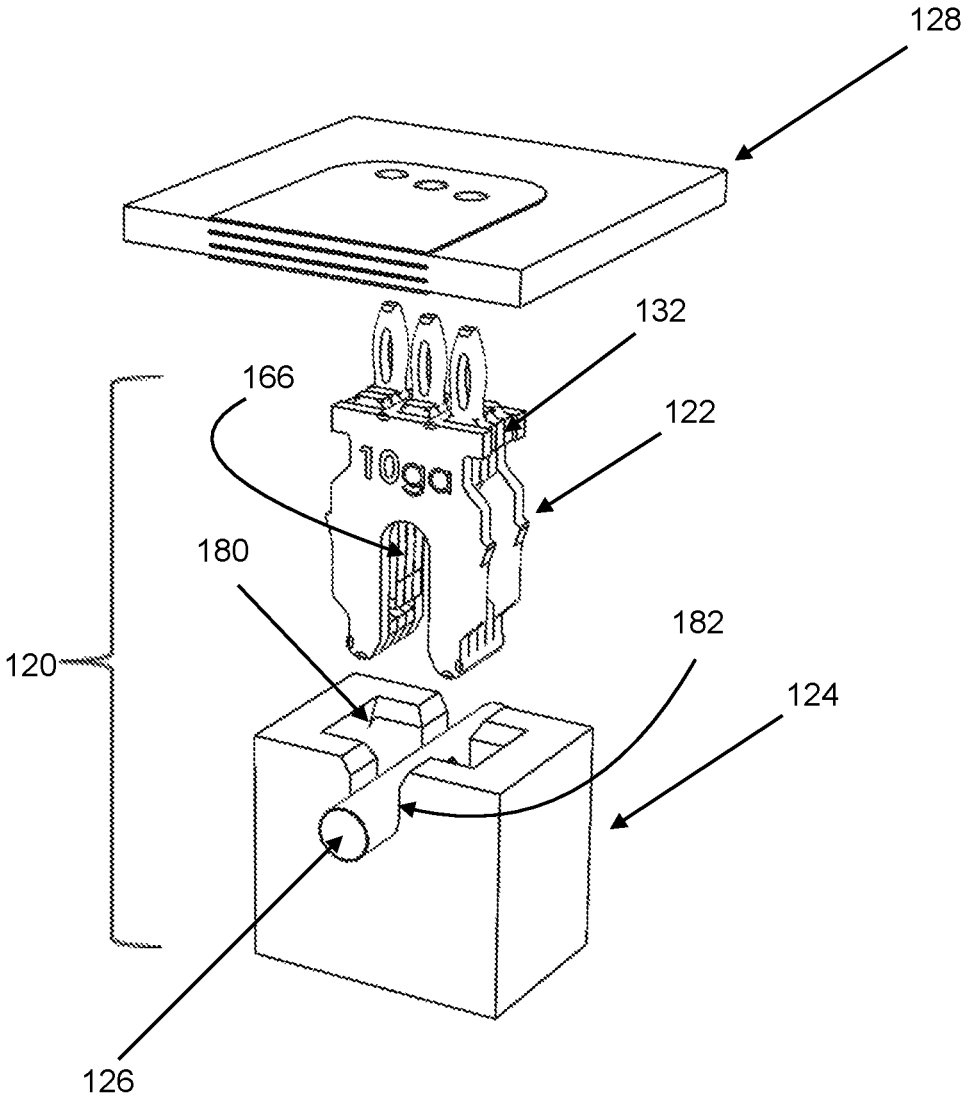
FIG. 6 shows a partially exploded perspective view of an insulation displacement connector (IDC) having an insulation displacement terminal (IDT)

Referring now to FIG. 6, there is shown a partially exploded view of an insulation displacement connector (IDC) 120 that generally includes a laminated insulation displacement terminal (IDT) 122 and a housing 124. The IDC 120 is operable to electrically connect an insulated wire 126 to an electrical/electronic device, such as a printed circuit board (PCB) 128. The wire 126 may have a conventional construction with an inner metal conductor covered with an outer insulation layer, which may be a coating or sheath composed of an insulating polymeric material. The wire 126 may have a diameter of 10 gauge or greater. While the IDC 120 is especially adapted for use with larger gauge wire, its use is not limited to larger gauge wire and may be used with any gauge wire.

Figure 7:
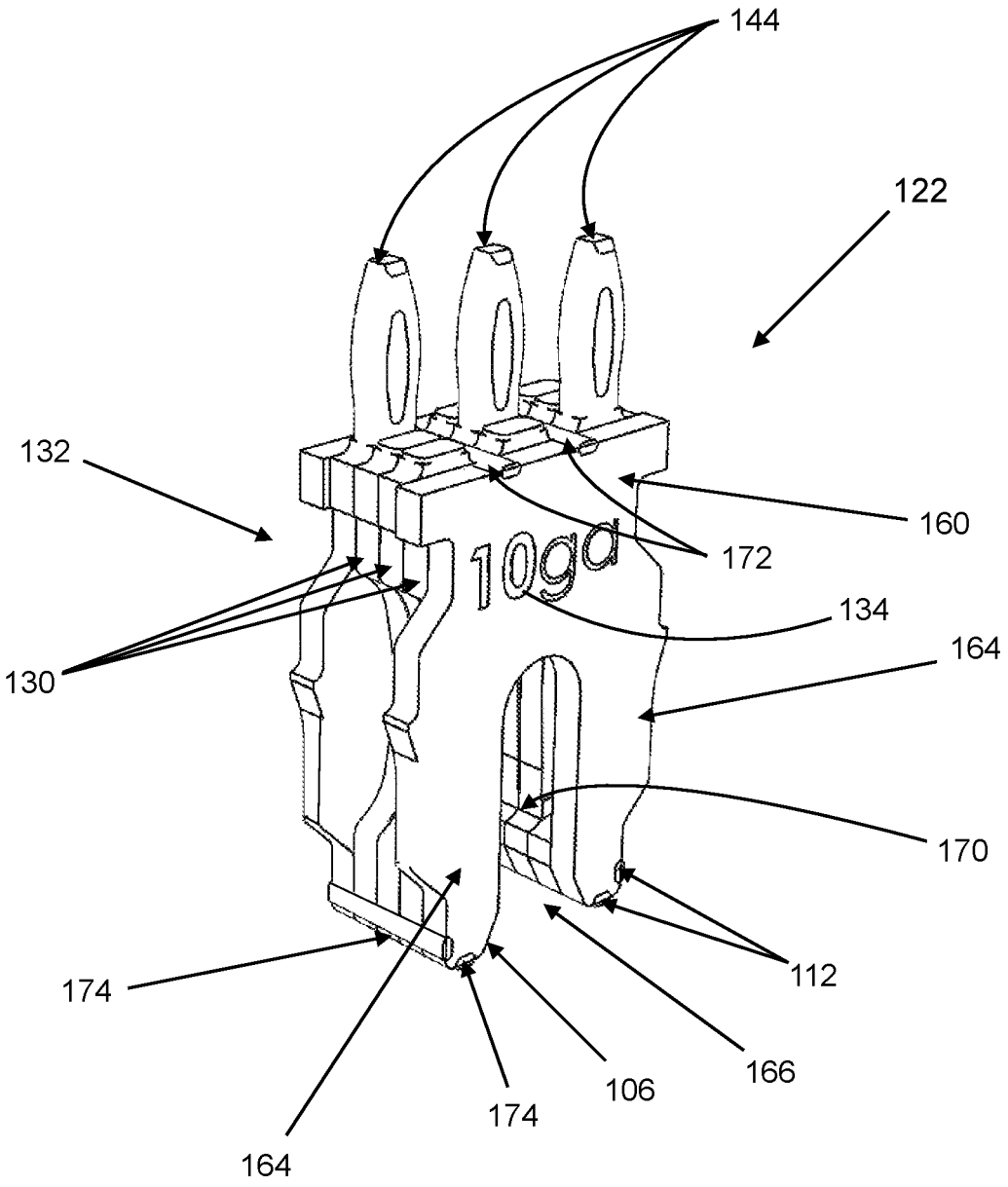
FIG. 7 shows a perspective view of the IDT shown in FIG. 6.
Figure 8:
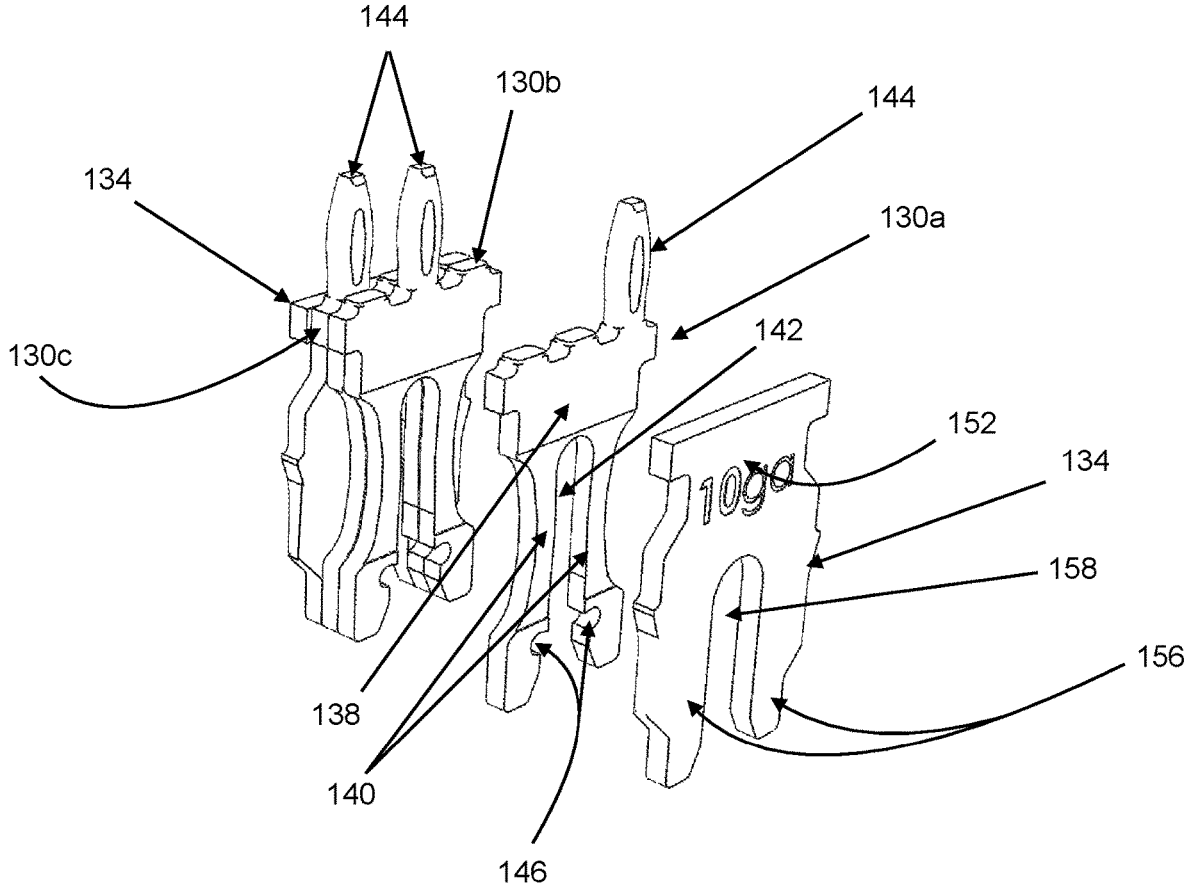
FIG. 8 shows a partially exploded perspective view of the IDT shown in FIGS. 6 and 7.

With reference now also to FIGS. 7 and 8, the IDT 122 include a plurality of plates arranged in a stack 132. The plates include a plurality of cutter plates 130 disposed between outer holding plates 134. Each cutter plate 130 includes a support substrate 135 (shown in FIG. 17) that is a unitary or monolithic structure that is electrically conductive. The support substrate 135 may be composed of a conductive metal, such as a tin-plated copper alloy. The support substrates 135 may be formed by stamping one or more sheets of the conductive metal. In one or more embodiments, each cutter plate 130 may further include one or more insulation coatings that are joined to the support substrate 135, as will be discussed in more detail below. In other embodiments, the stack 132 may include a plurality of separate insulation plates or webs that are interleaved with the cutter plates 130 (consisting of the support substrates 135), also as described further below. Even though the support substrates 135 are, in some embodiments, separated by insulation, the support substrates 135 in these embodiments are still electrically connected together to convey power, as described more fully below.

Figure 9:
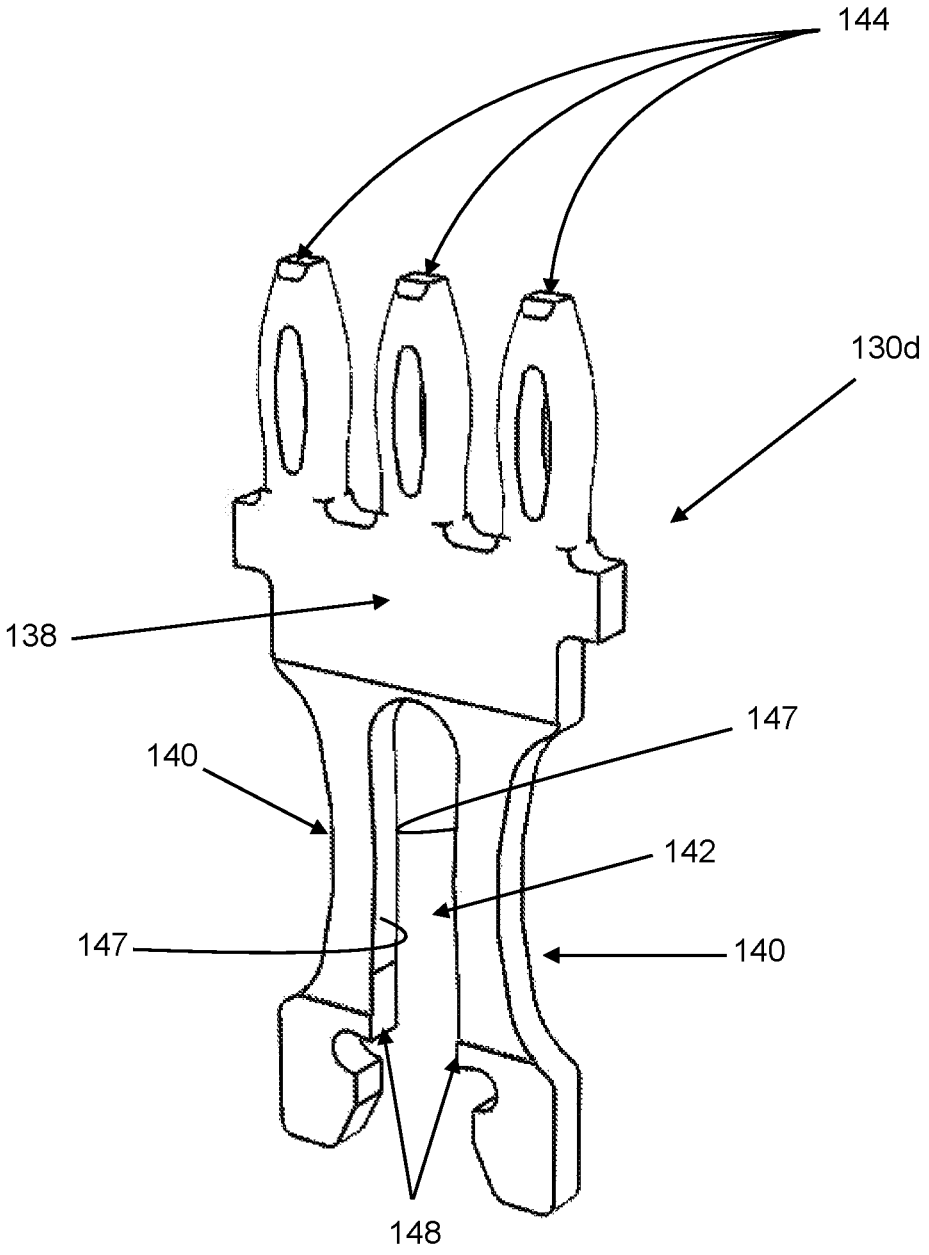
FIG. 9 shows a perspective view of a cutter plate having three contact projections.
Figure 10:
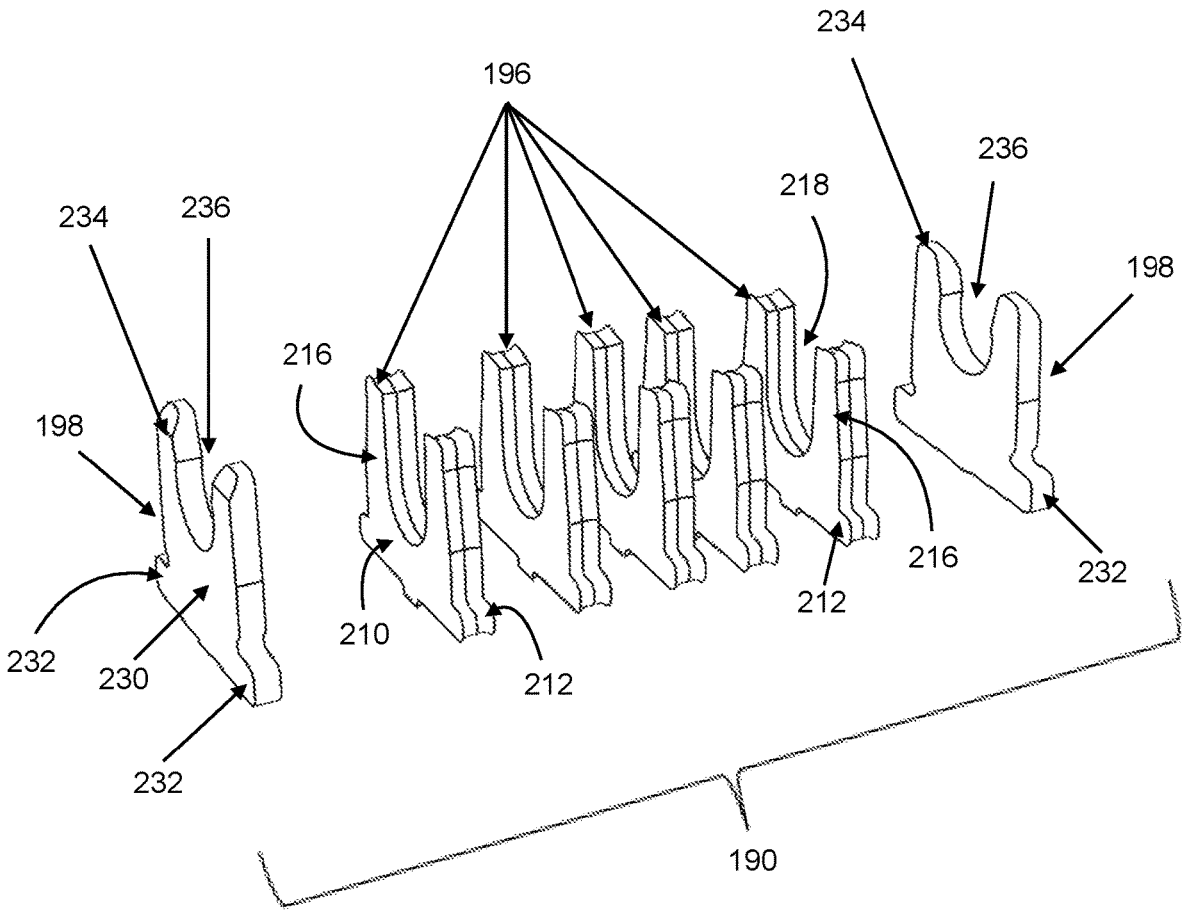
FIG. 10 shows an exploded view of another IDT.

With particular reference now to FIGS. 8 and 9, each cutter plate 130 includes a base 138 having a pair of engagement legs 140 extending therefrom in a first direction and one or more contact projections 144 extending therefrom in a second direction, which is opposite the first direction. The engagement legs 140 are separated by a slot 142. Each contact projection is adapted for making electrical connection with an electrical/electronic device. By way of non-limiting example, the contact projection 144 may be a press-fit contact projection (having an EON construction) for securement within a metal-plated hole of the PCB 128. Alternately, the contact projection 144 may be a pin or other type of construction. Moreover, the location of the contact projection 144 may differ among the cutter plates 130, as shown in FIGS. 6-8, with cutter plates 130*a, b, c*. In addition, a cutter plate 130 may have a plurality of contact projections, as shown in FIG. 9, with cutter plate 130*d*.

Notches 146 are formed in the engagement legs 140, toward their free ends, respectively. The notches 146 are arcuate and are defined by curved inside surfaces, respectively, which adjoin interior edges 147 of the engagement legs 140 at sharp corner ridges 148, respectively. The sharp ridges 148 extend in the direction of the thickness of the cutter plate 130 and function as scrapers and/or cutters for piercing the insulation layer of the wire 126 and are hereinafter referred to as cutters 148.

The holding plates 134 have a construction generally similar to the cutter plates 130. Unlike the cutter plates 130, however, the holding plates 134 do not have any cutters or scrapers for removing the insulation layer from the wire 126. In addition, the holding plates 134 are typically thicker than the cutter plates 130. Each holding plate 134 includes a support substrate 150 (shown in FIG. 17) that is a unitary or monolithic structure that is electrically conductive. The support substrate 150 may be composed of a conductive metal, such as a tin-plated copper alloy. The support substrates 150 may be formed by stamping one or more sheets of the conductive metal. In one or more embodiments, each holding plate 134 may further include one or more insulation coatings that are joined to the support substrate 150, as will be discussed in more detail below. In other embodiments, one or more separate insulation plates or webs may be disposed adjacent to the holding plates 134 (consisting of the support substrates 150), respectively, also as described further below.

Each holding plate 134 includes a base 152 having a pair of legs 156 extending therefrom in a first (downward) direction. In some embodiments, one or more contact projections may extend from the base 152 in a second direction, which is opposite the first direction. The legs 156 are separated by a slot 158.

With particular reference to FIG. 7, the plates 130, 134 are secured together in the stack 132 by electron beam welding or laser beam welding to provide the IDT 122 with a base 160 (which is formed by the bases 138, 152 of the cutter plates 130 and the holding plates 134) and a pair of legs 164 (which are formed by the engagement legs 140 of the cutter plates 130 and the legs 156 of the holding plates 134). The legs 164 of the IDT 122 are separated by a passage or groove 166 that is formed by the slots 146 in the cutter plates 130 and the slots 158 in the holding plates 134. The cutters 148 in each of the engagement legs 140 are aligned to form a laminated cutting edge 170.

Welds may be made in a plurality of locations. Preferably, there is at least one weld at the top of the base of the IDT 122 and at least one weld in each leg 164 of the IDT 122. As shown, a pair of upper welds 172 may be made across an upper portion of the base 160 of the IDT 122. Also, as shown, a pair of lower welds 174 may be formed in each leg 164 of the IDT 122, with one lower weld 174 extending across a lower outer side surface of the leg 164 and the other lower weld 174 extending across a free end of the leg 164. In forming the welds 172,174, filler metal in the form of wire or powder may be added to control the shape and size of the weld. For example, each weld 172, 174 may be provided with a crown (convex surface of the weld).

Referring back to FIG. 6, the housing 124 is configured for use with the IDT 122. The housing 124 may be formed of plastic and may have a cuboidal shape. The housing 124 may be secured to a second electrical/electronic device, such as a PCB, and, as such, may include features for mounting the housing 124 to the second electrical/electronic device. The housing 124 has an interior pocket 180 with a shape that corresponds to the shape of the IDT 122. Slots 182 cooperate with the pocket 180 to form a route through the housing 124. The wire 126 extends through the route in the housing 124 and rests against closed ends of the slots 182, thereby extending across and through the pocket 180.

With the wire 126 so positioned, the IDT 122 is pressed down into the pocket 180. As the IDT 122 moves into the pocket 180, the wire 126 (relatively speaking) enters and moves through the groove 166 unobstructed and then moves into contact with the laminated cutting edges 170, which pierce and/or cut the insulation layer of the wire 126. The continued (relative) movement of the wire 126 through the groove 166 displaces and/or removes portions of the insulation layer from the conductor, which then comes into contact with the interior edges 147 of the cutter plates 130. The conductor of the wire 126 is held in the groove 166 and engages the interior edges 147 of the cutter plates 130, thereby making an electrical connection between the wire 126 and the IDT 122.

From the foregoing description, it is clear that the wire 126 electrically connects together the cutter plates 130 and may act as a current distributor to provide electrical current to the cutter plates 130. In this manner, the wire 126 may convey electric power through the cutter plates 130 to circuits within the PCB 102.

Referring now to FIGS. 10-14, there is shown an IDT 190 for connecting a larger gauge wire 192, such as a magnet wire, to a bus bar 194 (shown in FIG. 14) composed of a conductive metal, such as copper or a copper alloy. The wire 192 may have a diameter of 10 gauge or greater. The IDT 190 has a plurality of cutter plates 196 disposed between a pair of outer, holding plates 198 to form a stack 200. Each cutter plate 196 includes a support substrate 202 (shown in FIGS. 13 and 19) that is a unitary or monolithic structure that is electrically conductive. The support substrate 202 may be composed of a conductive metal, such as a tin-plated copper alloy. The support substrates 202 may be formed by stamping one or more sheets of the conductive metal. In one or more embodiments, each cutter plate 196 may further include one or more coatings of insulation that are joined to the support substrate 202, as will be discussed in more detail below. In other embodiments, the stack 200 may include a plurality of insulation plates or separate insulation webs that are interleaved with the cutter plates 196 (consisting of the support substrates 202), also as described further below. Even though the support substrates 202, in some embodiments, may be separated by insulation, the support substrates 202 in these embodiments are still electrically connected together to convey power, as described more fully below.

Figure 12:
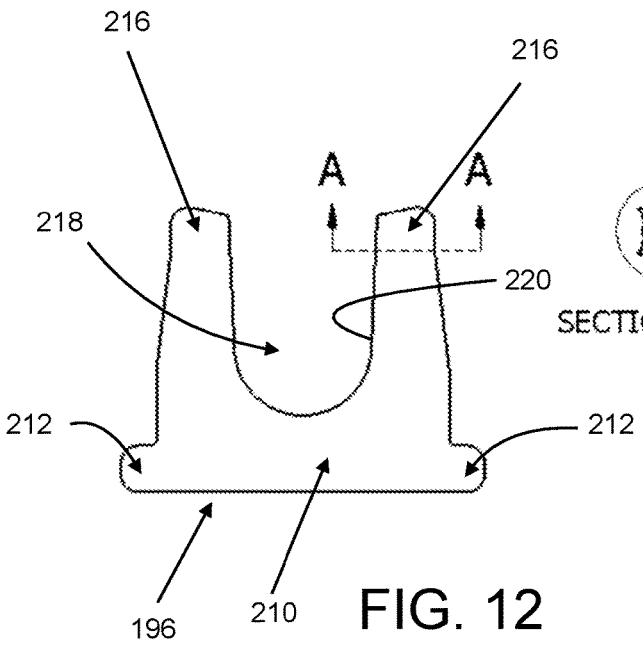
FIG. 12 shows a front elevational view of a first embodiment of a cutter plate of the IDT of FIGS. 10 and 11.
Figure 13:
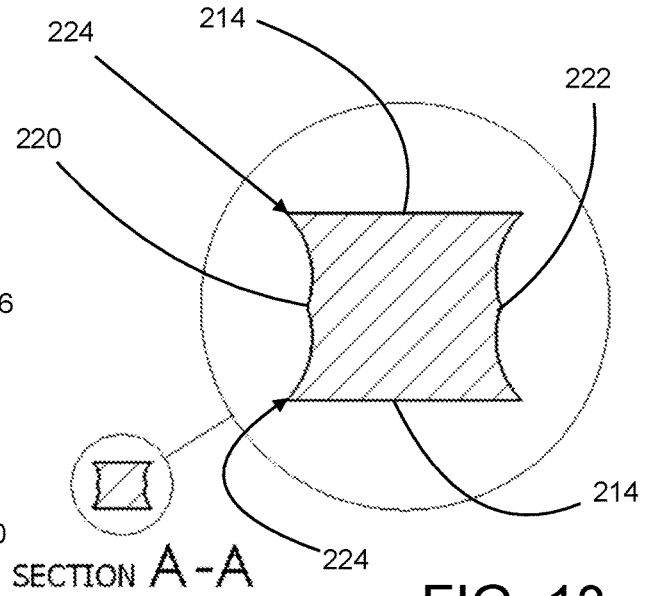
FIG. 13 shows a sectional view of the cutter plate of FIG. 12 taken along line A-A of FIG. 12.

With particular reference now to FIGS. 12-13, each cutter plate 196 includes a base 210 having a lower portion with outwardly-extending, opposing flanges 212. In addition, the support substrate 202 of each cutter plate 196 has opposing planar surfaces 214. A pair of engagement legs 216 extend upwardly from the base 210 and are separated by a slot 218 defined by inner surfaces 220 of the engagement legs 216 and an inner surface of a rounded, closed end. The inner surfaces 220 are formed in the support substrate 202 by chemical etching, which forms sharp edges 224 at the junctures between the inner surfaces 220 of the legs 216 and the planar surfaces 214. In this manner, the inner surfaces 220 are generally concave in the direction between the surfaces 214, as shown in FIG. 13. The sharp edges 224 in each engagement leg 216 extend longitudinally along substantially the entire length of the engagement leg 216. As will be described more fully below, the sharp edges 224 are operable to pierce an insulative coating on the wire 192. The engagement legs 216 have some elasticity so as to permit outward deflection.

The holding plates 198 have a construction generally similar to the cutter plates 196. Each holding plate 198 includes a support substrate 225 (shown in FIG. 21) that is a unitary or monolithic structure that is electrically conductive. The support substrate 225 may be composed of a conductive metal, such as a tin-plated copper alloy. The support substrates 225 may be formed by stamping one or more sheets of the conductive metal. In one or more embodiments, each holding plate 198 may further include one or more coatings of insulation that are joined to the support substrate 225, as will be discussed in more detail below. In other embodiments, one or more separate insulation plates or webs may be disposed adjacent to the holding plates 198 (consisting of the support substrates 225), respectively, also as described further below.

Each holding plate 198 includes a base 230 having a lower portion with outwardly-extending, opposing flanges 232. A pair of legs 234 extend upwardly from the base 230 and are separated by a slot 236 defined by inner surfaces of the legs 234 and a rounded, closed end. Unlike the cutter plates 196, however, the inner surfaces of the legs 234 do not have any sharp edges for removing the insulative coating from the wire 192.

The holding plates 198 have a more rigid construction than the cutter plates 196. In particular, the holding plates 198 are more rigid than the cutter plates 196 in a lateral direction, i.e., in a direction normal to the direction of the groove 240 formed by the cutter plates 196 and the holding plates 198 (described below).

Figure 11:
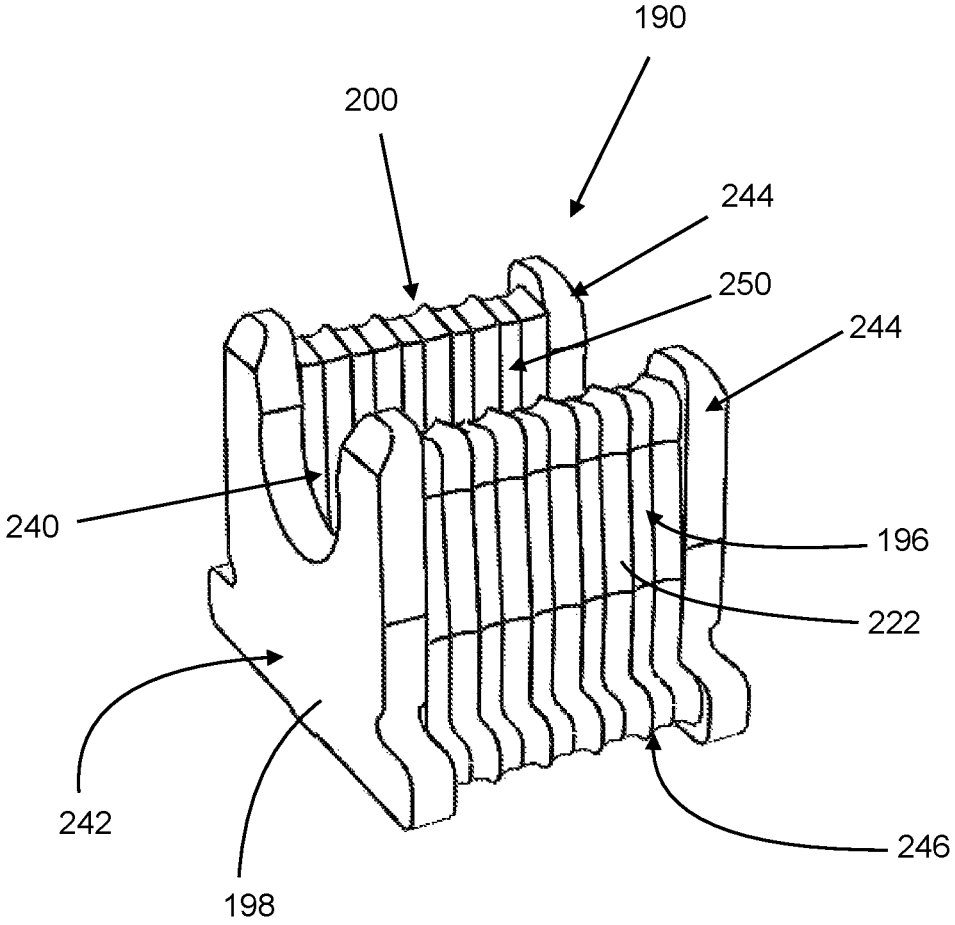
FIG. 11 shows a side perspective view of the IDT of FIG. 10.

With particular reference now to FIG. 11, the cutter plates 196 and the holding plates 198 are arranged in the stack 200 so as to provide the IDT 190 with a base 242 (which is formed by the bases 210, 230 of the cutter plates 196 and the holding plates 198) and a pair of legs 244 (which are formed by the engagement legs 216 of the cutter plates 196 and the legs 234 of the holding plates 198). The base 242 has outwardly-extending, opposing flanges 246 formed by the flanges 212, 232 of the cutter plates 196 and the holding plates 198. The legs 244 of the IDT 190 are separated by the passage or groove 240 that is formed by the slots 218 in the cutter plates 196 and the slots 236 in the holding plates 198. Inside the 240, the inner surfaces 220 of the engagement legs 216 of the cutter plates 196 adjoin each other so as to provide each leg 244 of the IDT 190 with a laminated, jagged inner surface 250, with the sharp edges 224 forming a series of parallel sharp ridges arranged in the stacking direction of the cutter plates 196.

The cutter plates 196 and the holding plates 198 are secured together in the stack by electron beam welding or laser beam welding. Welds may be made in a plurality of locations. For example, there may be a pair of welds on opposing sides of the base 242, respectively, and one or more welds in each leg 244.

Figure 14:
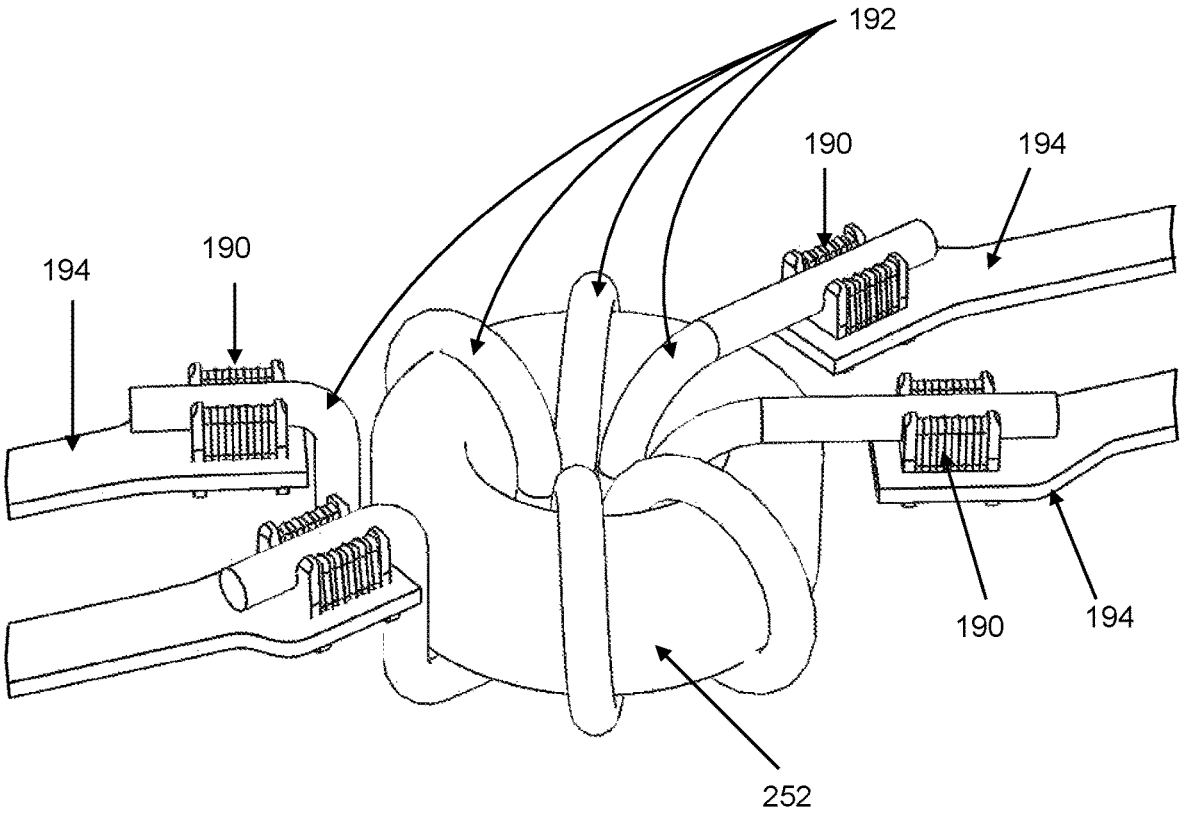
FIG. 14 shows a plurality of the IDTs of FIGS. 10 and 11 connecting wires from a magnet to a plurality of busbars, respectively.

Referring now to FIG. 14, there is shown a plurality of magnet wires 192 wound around a magnet core 252. End portions of the wires 192 are secured to bus bars 194 by IDTs 190, respectively. The end portion of each wire 192 is pressed into the groove 240 of its respective IDT 190, which causes the jagged inner surfaces 250 of the legs 244 to strip off any insulative coating on the wire 192, thereby making a good electrical connection between the wire 192 and the IDT 190. Exterior surfaces 222 of the cutter plates 196 engage and make electrical contact with inner edge surfaces of the bus bars 194. In each IDT 190, the elasticity of the engagement legs 216 of the cutter plates 196 maintain a high normal force on the wire 192 in the event of wire creep. The welded construction of the IDT 190, together with the holding plates 198, provide the IDT 190 with structural rigidity that resists motion of the wire 192.

From the foregoing description, it is clear that with regard to each IDT 190, the wire 192 electrically connects together the cutter plates 196 and may act as a current collector for current flowing through the cutter plates 196. In this manner, the cutter plates 196 may convey power from the bus bar 194 to the wire 192.

For applications where the coupler 10 carries direct current (DC) or alternating current (AC) of lower frequencies (e.g. 60 Hz or less), the stack 12 of the coupler 10 may consist only of the contact plates 14, wherein each of the contact plates 14 consists only of the support substrate 15. Thus, when the contact plates 14 are stacked together to form the stack 12, the planar metal surfaces of the support substrates 15 adjoin each other.

Similarly, where the IDT 122 and the IDT 190 carry DC or AC of lower frequencies (e.g. 60 Hz or less), their stacks 132, 200, respectively, may each consist only of the cutter plates and the holding plates, wherein each of the cutter plates and the holding plates consists only of a metal support substrate. Thus, when the cutter plates and the holding plates are stacked together to form their stack (132 or 200), the planar metal surfaces of the support substrates adjoin each other.

For applications where the coupler 10 carries AC of higher frequencies (e.g. greater than 60 Hz), the support substrates 15 of the contact plates 14 are separated from each other by some form of insulation. The insulation may be insulation coatings, insulation plates or webs or air gaps. The insulation alleviates electrical resistance due to the skin effect that is associated with electrical currents of higher AC frequencies.

Similarly, for applications where the IDT 122 and IDT 190 carry AC of higher frequencies (e.g. greater than 60 Hz), the support substrates of the cutter plates and the holding plates are separated from each other by some form of insulation. The insulation may be insulation coatings, insulation plates or sheets or air gaps. The insulation alleviates electrical resistance due to the skin effect that is associated with electrical currents of higher AC frequencies.

Figure 15:
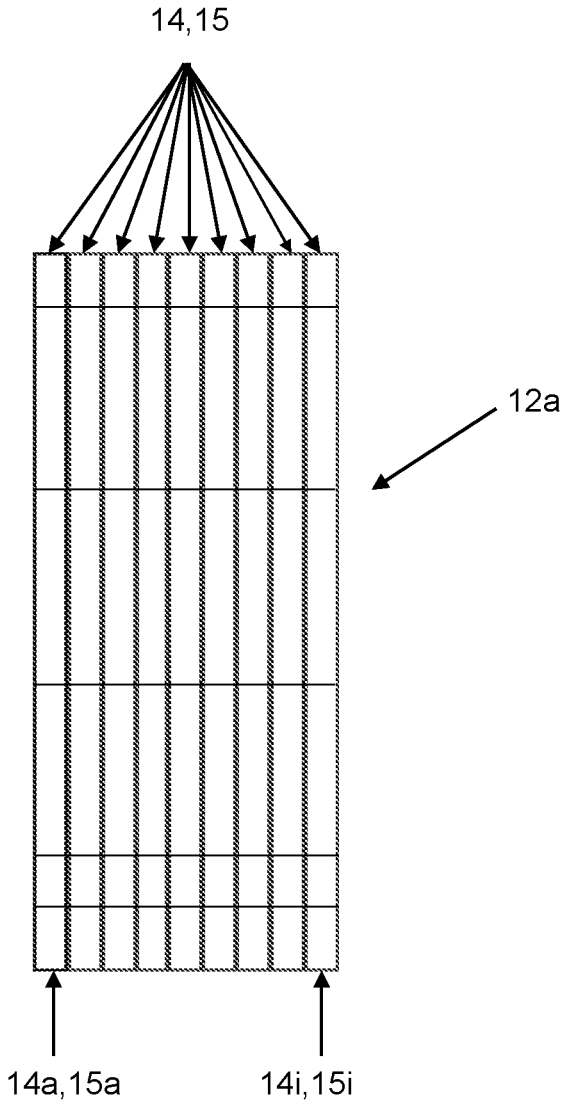
FIG. 15 shows a side view of a first embodiment of the stack shown in FIG. 2.

This skin effect may be explained by referring to FIG. 15, which shows a side view of a stack 12*a* that consists of adjoining support substrates 15 of the contact plates 14, i.e., no insulation is provided, whether as layers on the support substrates 15 or otherwise. When the coupler 10 carries DC or AC of lower frequencies (e.g. 60 Hz or less), the resistance of each contact plate 14 to current flow between its first portion 22 and its second portion 24 depends on the cross-sectional area of its support substrate 15, i.e., its thickness. Moreover, the stack 12*a* effectively forms a single conductor, wherein the overall resistance to current flow in the stack 12 depends on the total thickness of the stack 12*a*, i.e., the number of support substrates 15 multiplied by the individual thickness of each support substrate 15. Thus, by way of example, if nine contact plates 14 (consisting of support substrates 15) are provided and each contact plate 14 (support substrate 15) is 0.4 mm thick, the stack 12*a* would effectively form a single conductor having a thickness of 3.6 mm. In this regard, it is noted that for a given length of a conductor, the larger its cross sectional area, the lower its resistance (or impedance) to current flow.

When the stack 12*a* instead carries AC of higher frequencies (e.g. greater than 60 Hz or greater), it is believed that skin effect occurs wherein the AC current does not penetrate deeply into the stack 12*a* due to eddy currents induced in the contact plates 14 (consisting of the support substrates 15). Instead, the AC current is believed to flow near the outer surfaces of the stack 12*a*. More specifically, the AC current is believed to flow in the outer surfaces of the outer contact plate 14*a* (support substrate 15*a*) and the outer contact plate 14*i* (support substrate 15*i*).

The formula to relate skin depth, δ, may be defined as the depth below the surface of the conductor at which the current density has fallen to 1/e (about 0.37) of current density, $J_S$, on the surface, $$\delta=\mathrm{sqrt}\{(2*\rho)/(\omega*\mu)\};$$

where,

ρ=resistivity of the conductor;

ω=2π×frequency of AC current;

μ=magnetic permeability of the conductor.

It can be concluded that skin depth, δ, is inversely proportional to the square root of AC frequency, ω. If AC frequency, f, increases from 1 HZ to 100 Hz, the skin depth, δ, would reduce to one-tenth of the original value. In this regard, it may be noted that the skin effect (depth) is independent of cross sectional dimensions. Instead, skin effect depends on the frequency (f, or ω=2π*f), and electrical resistivity (p) and magnetic permeability (μ) of the conductor. For a copper alloy, such as that from which a support substrate 15 may be formed, the skin depth for AC flow of 400 kHz would be about 0.1 mm. Applying this to the stack 12*a* produces a total skin depth of 2*0.1 mm=0.2 mm (for the two outer contact plates 14*a* and 14*i*). In other words, the skin effect (at 400 kHz) effectively reduces the cross-sectional area of current flow in the stack 12*a* by a factor of 18 (corresponding to a reduction in thickness of 3.6 mm down to 0.2 mm). This reduction in cross-sectional area, in turn, corresponds to a commensurate increase in impedance of about 18 times.

Figure 16:
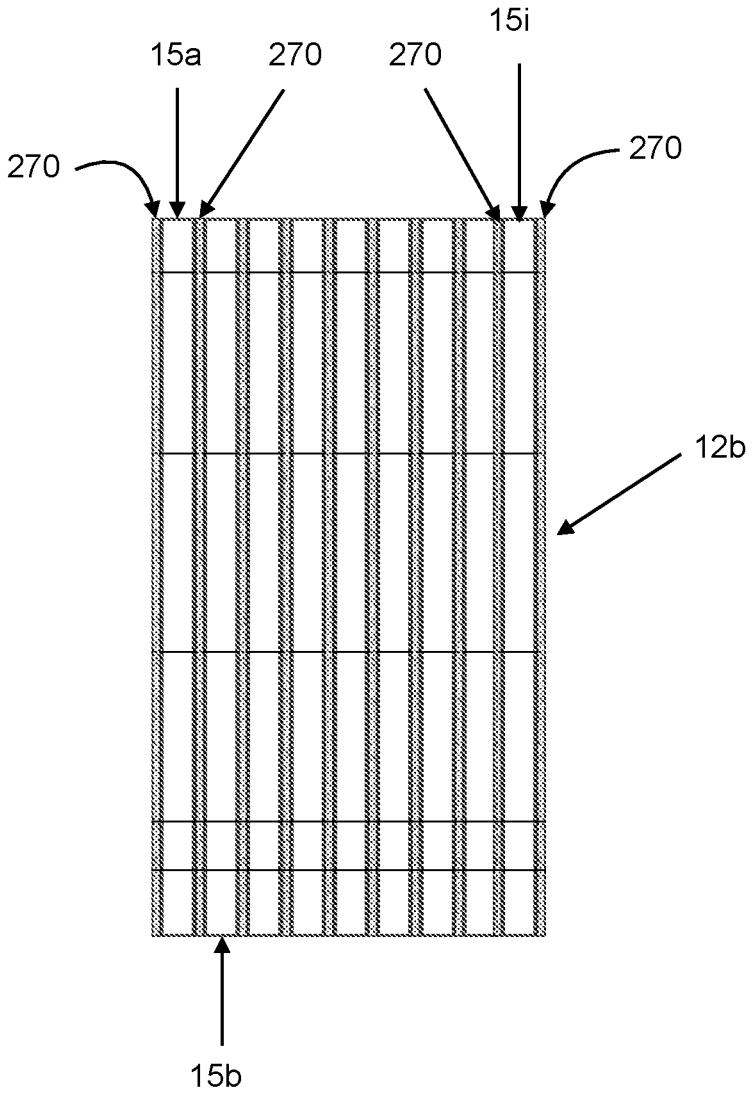
FIG. 16 shows a side view of a second embodiment of the stack shown in FIG. 2.

Providing a stack 12*b* with insulation between the support substrates 15 (such as by using insulation layers 270), as shown in FIG. 16, significantly reduces the impedance of the coupler 10 at higher AC frequencies from that of the coupler 10 without insulation, as described above. This reduction occurs because the insulation separates the support substrates 15 such that the support substrates 15 become individual conductors rather than effectively forming a single conductor, such as is the case in the stack 12*a*. Applying the 0.1 mm skin depth of a copper alloy for AC flow at 400 kHz (described above) to the stack 12*b* of nine support substrates 15 separated by insulation produces a total skin depth of 9*2*0.1=1.8 mm, which is an increase by a factor of 9 over the total skin depth (0.2 mm) of the stack 12*a*. This increase in total skin depth, in turn, corresponds to a commensurate decrease in impedance of about 9 times.

Figure 17:
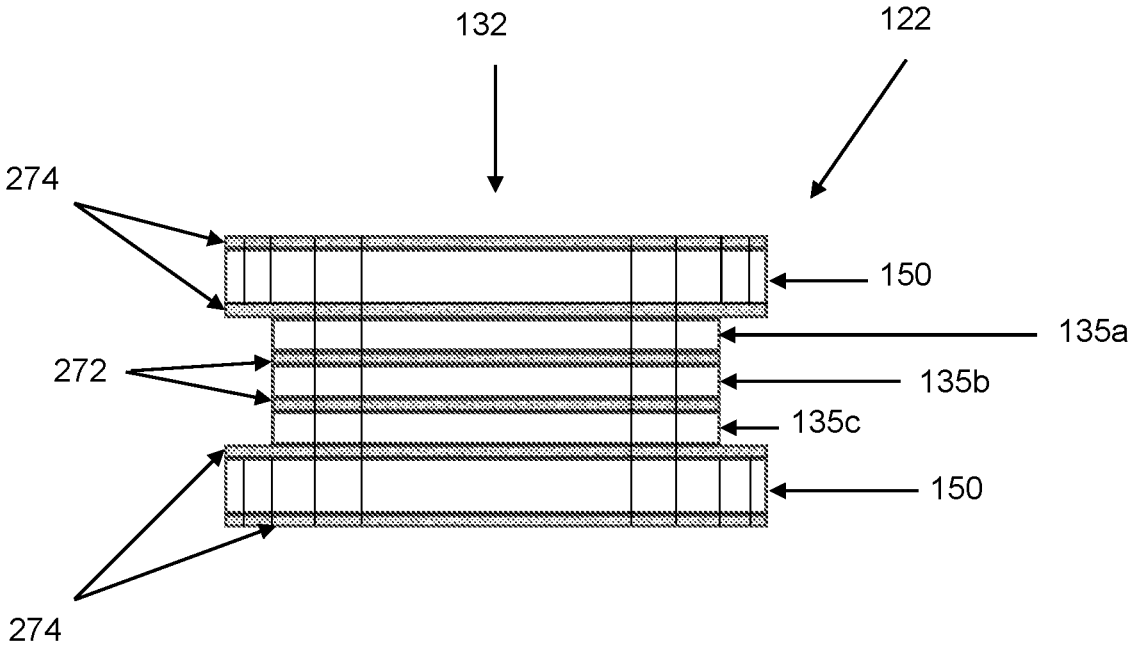
FIG. 17 is a bottom end view of an embodiment of the IDT shown in FIGS. 6-8.
Figure 18:
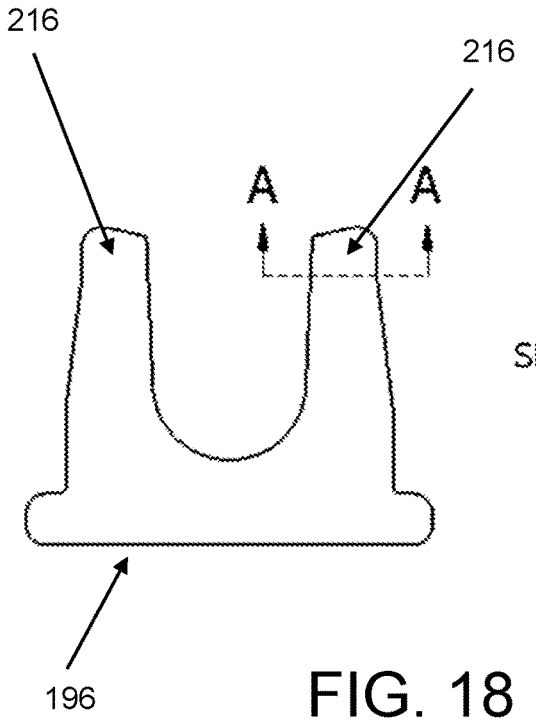
FIG. 18 shows a front elevational view of a second embodiment of a cutter plate of the IDT of FIGS. 10 and 11.

In a similar manner to the coupler 10, providing the IDTs 120, 190 with insulation between the support substrates of the cutter plates and the holding plates (such as by using insulation layers, as shown in FIGS. 17, 18), significantly reduces impedance of the IDTs 120,190 at higher AC frequencies from that of the IDTs 120, 190 without insulation.

Figure 19:
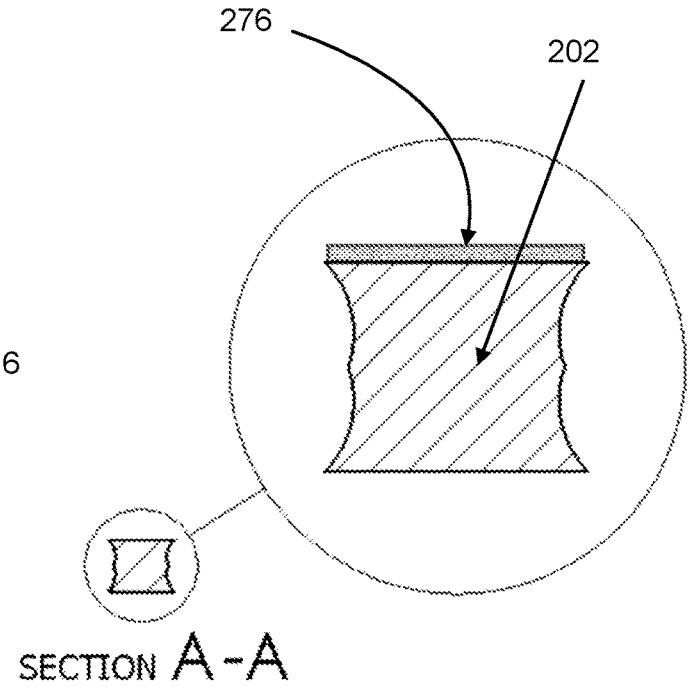
FIG. 19 shows a sectional view of the cutter plate of FIG. 18 taken along line A-A of FIG. 18.
Figure 20:
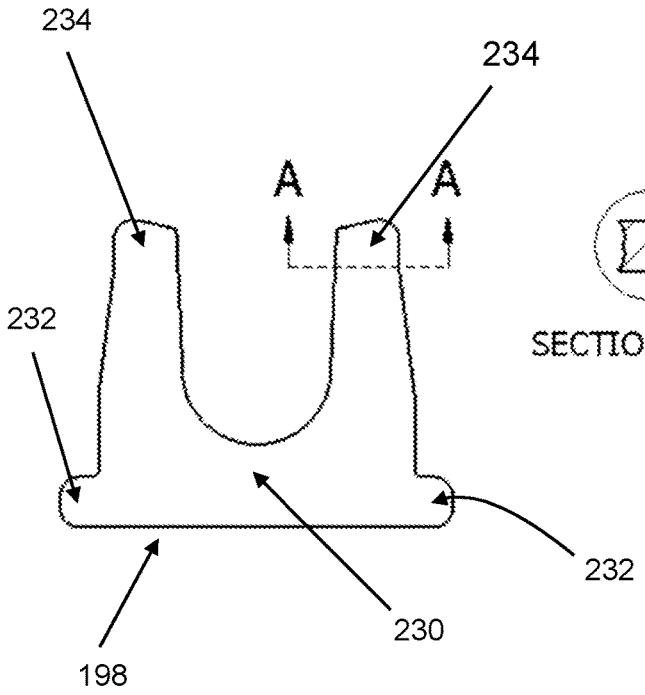
FIG. 20 shows a front elevational view of an embodiment of a holding plate of the IDT of FIGS. 10 and 11.
Figure 21:
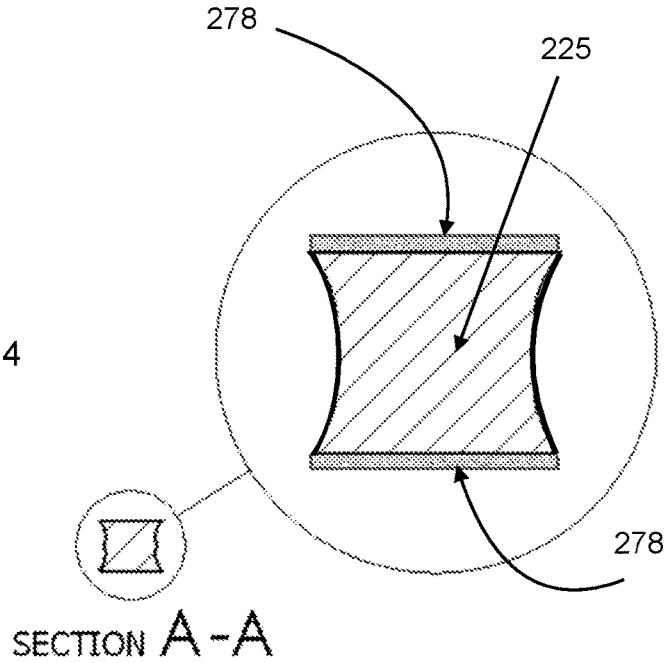
FIG. 21 shows a sectional view of the holding plate of FIG. 20 taken along line A-A of FIG. 20.

Reference is now made to FIGS. 16, 17, 19, 21. FIG. 16 is a side view of a stack 12*b* for use in a coupler 10. In the stack 12*b*, each contact plate 14 includes a support substrate 15 having its opposing planar metal surfaces adjoining insulation layers 270, respectively. FIG. 17 is a bottom end view of an IDT 122 in which the support substrate 135 of each cutter plate 130 has an insulation layer 272 adjoining at least one of its planar faces and the support substrate 150 of each holding plate 134 has insulation layers 274 adjoining its opposing planar faces. FIG. 19 is a cross-sectional view of an engagement leg 216 of a cutter plate 196 showing an insulation layer 276 disposed adjacent to a planar face of the support substrate 202. FIG. 21 is a cross-sectional view of an engagement leg 234 of a holding plate 198 showing insulation layers 278 disposed adjacent to opposing faces of the support substrate 225.

In some embodiments, the insulation layers 270, 272, 274, 276, 278 may be coatings bonded or otherwise adhered to the support substrates 15, 135, 150, 202, 225, respectively. In other embodiments, the insulation layers 270, 272, 274, 276, 278 may be separate plates or webs that are not adhered to the support substrates 15, 135, 150, 202, 225. In these embodiments, the plates are at least semi-rigid and the webs are at least semi-flexible.

The insulation layers 270, 272, 274, 276, 278 may each be a coating formed from a thermoplastic resin, such as a polyamide (e.g. nylon), polyoxymethylene (POM), polycarbonate (PC), polyphenylene ether (including a modified polyphenylene ether), polybutylene terephthalate (PBT), polyethylene terephthalate (PET), polyethylene naphthalate (PEN), ultrahigh molecular weight polyethylene, polysulfone (PSF), polyether sulfone (PES), polyphenylene sulfide (PPS), polyarylate (U polymer), polyether ketone (PEK), polyarylether ketone (PAEK), tetrafluoroethylene/ethylene copolymer (ETFE), polyether ether ketone (PEEK), tetrafluoroethylene/perfluoalkylvinylether copolymer (PFA), polytetrafluoroethylene (PTFE), a thermoplastic polyimide resin (TPI), polyamideimide (PAI), a liquid crystal polyester, or a combination of any of the foregoing.

In some embodiments, rather than being formed from thermoplastic resin, the insulation layers 270, 272, 274, 276, 278 may each be a coating formed from a thermoset resin, such as an epoxy, acrylic urethane, polyester urethane, silicone epoxy, a polyester resin cross-linked with triglycidyl isocyanurate (TGIC), a glycidyl methacrylate (GMA) functional acrylic polymer, or a combination of any of the foregoing. The coating may also be formed from a polyester imide (PEI) varnish or a polyamide imide (PAI) enamel.

In those embodiments where the insulation layers 270, 272, 274, 276, 278 are composed of polymeric resin, the insulation layers may be formed on the support substrates 15, 135, 150, 202, 225 by dip coating, solution coating, knife coating (air or blade), printing, powder coating, spray coating or other suitable type of coating process. The particular method of forming the insulation layers may depend on the composition of the resin forming the insulation layers. The resin composition and its method of application to the support substrates 15, 135, 150, 202, 225 are selected to provide the insulation layers 270, 272, 274, 276, 278 with desirable characteristics, such as minimal thickness, flexibility during metal forming, good metal adhesion, good electrical insulation, and being able to withstand elevated temperatures without loss of properties.

The thickness of the coating of polymeric resin (thermoplastic or thermoset) is dependent on the thickness of the underlying support substrate, the particular resin that is used and the method of applying the resin to the substrate. Generally, the ratio of the thickness of an insulation layer (270 etc.) that is composed of polymeric resin to the thickness of the underlying support substrate (15 etc.) is less than 2:1, more preferably less than 1:1, still more preferably less than 1:4. Thus, in an embodiment where the support substrate 15 of the contact plate 14 has a thickness of 0.4 mm, the insulation layer 270 has a thickness less 0.8 mm, more preferably less than about 0.4 mm still more preferably less than 0.1 mm (100 μm).

Epoxy resins (such as resins made from epichchlorohydrin and bisphenol A, or epichlorohydrin and aliphatic polyols, such as glycerol) applied by powder coating are particularly suitable for forming the insulation layers 270, 272, 274, 276, 278. Such epoxy resins are typically cured using amine or amide curing agents that are activated by elevated temperatures. Another particularly suitable resin is PTFE, which may be applied by spray coating. PTFE has good insulative properties and has a low coefficient of friction, which will facilitate the pivoting of the contact plates 14 in the coupler 10, as described above.

In some embodiments, rather than being an organic coating (such as a thermoplastic or thermoset resin), the insulation layers 270, 272, 274, 276, 278 may each be a coating formed from an inorganic material, such as glass, ceramic or glass-ceramic. Glass materials that may be used may consist of silicon dioxide ($SiO_2$) or may comprise silicon dioxide ($SiO_2$) or quartz and further include components such as boric oxide ($B_2O_3$) and aluminum oxide or alumina ($Al_2O_3$). Examples of ceramic materials that may be used include aluminum oxide ($Al_2O_3$), magnesium oxide (MgO), aluminum nitride (AlN), aluminum oxynitride (AlON) and zirconium oxide ($ZrO_2$). Examples of glass-ceramic materials that may be used include those in the following glass-ceramic systems: $Li_2O$—$Al_2O_3$—$SiO_2$ System (i.e., LAS-System); 2) MgO—$Al_2O_3$—$SiO_2$ System (i.e., MAS-System); and 3) ZnO—$Al_2O_3$—$SiO_2$ System (i.e., ZAS-System).

In those embodiments where the insulation layers 270, 272, 274, 276, 278 are composed of inorganic material, the insulation layers may be formed on the support substrates 15, 135, 150, 202, 225 by a thermal oxidation process, a coating process, a printing process or a deposition process. Examples of deposition processes include physical vapor deposition (PVD), such as sputtering, chemical vapor deposition (CVD) and cyclical deposition process, such as atomic layer deposition (ALD). The particular method of forming the insulation layers may depend on the composition of the inorganic material forming the insulation layers. The inorganic material and its method of application to the support substrates 15, 135, 150, 202, 225 are selected to provide the insulation layers 270, 272, 274, 276, 278 with desirable characteristics, such as minimal thickness, flexibility during metal forming, good metal adhesion, good electrical insulation, and being able to withstand elevated temperatures without loss of properties.

The thickness of the coating of inorganic material is dependent on the thickness of the underlying support substrate, the particular inorganic material that is used and the method of applying the inorganic material to the substrate. Generally, the ratio of the thickness of an insulation layer (270 etc.) that is composed of inorganic material to the thickness of the underlying support substrate (15 etc.) is less than 2:1, more preferably less than 1:50, still more preferably less than 1:200. Thus, in an embodiment where the support substrate 15 of the contact plate 14 has a thickness of 0.4 mm, the insulation layer 270 has a thickness less than 0.8 mm, more preferably less than 0.008 mm (8 μm), still more preferably less than 0.002 mm (2 μm).

Metal oxide ceramics (such as aluminum oxide, magnesium oxide, aluminum nitride, aluminum oxynitride and zirconium oxide) formed by PVD, such as sputtering, are particularly suitable for forming the insulation layers 270, 272, 274, 276, 278.

The insulation layers 270, 272, 274, 276, 278 may be formed during the manufacture of the contact plates 14, the cutter plates 130, the holding plates 134, the cutter plates 196 and the holding plates 198, respectively. As set forth above, each of the foregoing types of plates may be stamped from one or more planar sheets of the conductive metal that form the support substrates. More specifically, a planar sheet may be stamped in a blanking operation in which a punch and die are used to form a plurality of plates of a particular type from the sheet. Before a planar sheet is stamped, it may be coated on one or both of its planar sides with a desired resin (such as by powder coating) or with a desired inorganic material, such as by PVD.

In a powder coating operation, an electrostatic or corona gun may be used to spray electrically-charged powder onto each side of the planar sheet, which is electrically grounded. The powder may be solid particles or atomized liquid. The gun imparts a positive electric charge to the powder as it propels the powder by compressed air toward the planar sheet. The electrostatic charge accelerates the powder toward the planar sheet and helps the powder cover and adhere to the planar sheet. After the powder is applied, the planar sheet is heated to melt the powder into a uniform film (and, with regard to epoxy, cure the resin). The planar sheet is then allowed to cool so that hard coatings (insulation layers) are formed.

In lieu of using a spray gun to apply the resin powder to a planar sheet, the resin powder may be applied to the planar sheet in a fluidized bed. The resin powder and an electrostatic charging medium are loaded into an enclosure with a bed and then fluidized with air to create a cloud of electrically charged powder above the bed. The planar sheet, which is grounded, is then passed through the charged cloud to attract the powder particles to its opposing planar surfaces. The planar sheet is then heated and cooled as described above.

In a sputtering process, the planar sheet is placed in a PVD process chamber with a target material (such as an aluminum). A magnetron may be located in the process chamber and may include a center cathode and an annular outer anode. The cathode may be located directly behind the target, while the anode may be connected to a chamber wall as electrical ground. When energized, the magnetron produces strong electric and magnetic fields.

Initially, the process chamber is evacuated to a high vacuum. Then, a process gas is injected into the process chamber. The process gas typically includes an inert gas, such as argon, and may further include one or more reactive gases, such as oxygen and/or nitrogen. When the magnetron is energized, a plasma is generated from the process gas.

Positive ions from the plasma accelerate toward the cathode, which causes high energy collisions with the surface of the target material, thereby ejecting atoms from the target. These ejected atoms may react with reactive gas atoms (such as oxygen and/or nitrogen) to form a compound (such as aluminum oxide), which is then deposited on the planar sheet.

After a planar sheet has been coated with resin or an inorganic material, the planar sheet may be stamped in a blanking operation to form a plurality of plates of a particular type, with an insulation layer adhering to one or both of the planar surfaces of each plate. The sheering that occurs during the blanking operation ensures that the interior edges and the exterior edges of each plate are free from resin or inorganic material and consist of the bare metal of the underlying support substrate. In this regard, it should be noted that the only portions of a plate (e.g. a contact plate 14 or a cutter plate 130 or 196) that need to be free of insulating coating and have exposed metal are those portions that make electrical contact with another electrical component (e.g. the mounting contact 70 or the conductor of the wire 126 or 192, etc.). Thus, by way of example, the interior edges 21, 23 of the contact plates 14, the interior edges 147 of the cutter plates 130 and the inner surfaces 220, the sharp edges 224 and the outer surfaces 222 of the cutter plates 196 need to be free of coating and have exposed metal.

Thus, by way of example, a planar metal sheet that has been coated with resin or inorganic material (on one or both of its planar sides) may be stamped to form a plurality of contact plates 14. The sheering that occurs removes the resin or inorganic material from the interior edges 21, 23 so as to expose the bare metal of the underlying support substrate 15. As such, when the contact plates 14 are assembled in the coupler 10 and the coupler 10 is used as part of an electrical connector, electrical current may flow through the interior edges 21, 23 of the contact plates 14, between a contact such as the mounting contact 90 that engages the interior edge 21 and another contact, such as the contact 74, that engages the interior edge 23.

In those embodiments where the support substrates 15, 135, 150, 202, 225 are coated with a polymer resin or inorganic material, the coatings may be formed on the support substrates such that there is only one coating between a pair of adjacent support substrates. Thus, by way of example, in the stack 12*b* of the coupler 10 shown in FIG. 16, the support substrates 15*b* through 15*i* each have only their right planar face coated with an insulation layer 270; however, both planar faces of the support substrate 15*a* is coated with an insulation layer 270. As a further example, in the stack 132 of the IDT 122 shown in FIG. 17, the support substrates 150 each have both of their planar surfaces coated with insulation layers 274, while the support substrates 135*a* and 135*b* only have their bottom (as shown in FIG. 17) planar surfaces coated with insulation layers 272 and the support substrate 135*c* does not have any of its planar surfaces coated, i.e., both planar faces are bare metal. Of course, while not shown in the drawings, coatings may be provided on both planar surfaces on each of the support substrates In some embodiments, rather than coating a planar sheet before it is stamped to form plates, the plates may be coated after the plates have been formed through stamping. In these embodiments, the edges of the plates that need to be free from resin or inorganic material (e.g., the interior edges 21, 23 of the contact plates 14) may be masked or otherwise covered during the coating of the plate to prevent the deposition of resin or inorganic material on them. Alternately, the edges may be cleaned off after the coating process.

Instead of being coatings adhered to the support substrates 15, 135, 150, 202, 225, the insulation layers 270, 272, 274, 276, 278 may, in some embodiments, be separate plates that are not adhered to the support substrates. For example, the insulation layers 270, 272, 274, 276, 278 may be separate insulating plates that are semi-rigid and composed of an insulating plastic such PTFE, polyethylene, or a nylon, such as nylon 6 or nylon 6/6. The nylon (such as nylon 6/6) may include fillers (such as molybdenum disulfide) to improve its properties. The insulating plates may have the same configuration as the support substrates of the contact plates, the cutter plates and the holding plates they are disposed adjacent to, but may have a different thickness. Thus, by way of example, the insulation layers (plates) 270 may have the same shape or configuration as the support substrates 15 and will help form the stack 12 with the first and second receiving grooves 42, 44 formed therein; the insulation layers (plates) 272, 274 may have the same shape or configuration as the support substrates 135, 150, respectively, and will help form the stack 132 with the groove 166 formed therein; and the insulation layers (plates) 276, 278 may have the same shape or configuration as the support substrates 202, 225, respectively, and will help form the stack 200 with the groove 240 formed therein.

The thickness of a plate (forming an insulation layer) is dependent on the thickness of the adjacent plate (composed of metal). Generally, the ratio of the thickness of an insulation layer (270 etc.) that is comprised of a plate to the thickness of an adjacent plate (14 etc.) may be in a range of from about 1:10 to about 2:1, more preferably in a range of from about 1:5 to about 1:1. Thus, in an embodiment where the contact plate 14 has a thickness of 0.4 mm, the insulation layer 270 (comprised of a plate) may have a thickness that is in a range of from about 0.04 mm to about 0.8 mm, more preferably in a range from about 0.08 mm to about 0.4 mm.

In still other embodiments, the insulation layers 270, 272, 274, 276, 278 may be separate webs that are not adhered to the support substrates. For example, the insulation layers 270, 272, 274, 276, 278 may be separate flexible webs composed of insulating paper or film. Examples of suitable insulating paper include cellulose paper, fishpaper, inorganic paper and non-cellulose polymer paper, such as Nomex®, which is paper formed from fibers of a meta-aramid polymer.

An example of an inorganic paper is a paper formed from glass fibers and/or microfibers, which may further include inorganic fillers and an organic binder that is typically present in an amount less than 10% by weight. Such an inorganic paper is commercially available from the 3M Company under the trademark CeQuin®

Another example of suitable insulating film is a polyethylene film, such as a film formed from biaxially-oriented PET, which is sold under the trademark Mylar®.

The insulating webs may have the same configuration as the contact plates, the cutter plates and the holding plates they are disposed adjacent to, but may have a different thickness. Thus, by way of example, the insulation layers (webs) 270 may have the same shape or configuration as the support substrates 15 and will help form the stack 12 with the first and second receiving grooves 42, 44 formed therein; the insulation layers (webs) 272, 274 may have the same shape or configuration as the support substrates 135, 150, respectively, and will help form the stack 132 with the groove 166 formed therein; and the insulation layers (webs) 276, 278 may have the same shape or configuration as the support substrates 202, 225, respectively, and will help form the stack 200 with the groove 240 formed therein.

In some embodiments, the webs of paper or film described above may be adhered to the support substrates 15, 135, 150, 202 by an electrically insulating adhesive and, as such, may be considered insulating tapes. The insulating adhesive may be a structural adhesive or a pressure-sensitive adhesive, which, in turn, may be permanent or removable. By way of example, the insulating adhesive may be silicone-based, epoxy-based, polyurethane-based or rubber-based. In addition, the insulating adhesive may include ceramic particles, such as aluminum oxide, aluminum nitride and/or boron nitride. Each web that is adhered to a support substrate only has one side that is provided with the insulating adhesive; the other side of the web being clear of adhesive. In this manner, if the contact plates 14 are provided with webs with adhesive (insulating tapes), adjacent contact plates 14 may move relative to each other, without interference from adhesive.

The thickness of a web (forming an insulation layer) is dependent on the thickness of the adjacent plate (composed of metal). Generally, the ratio of the thickness of an insulation layer (270 etc.) that is comprised of a web to the thickness of an adjacent plate (14 etc.) may be in a range of from about 1:10 to about 2:1, more preferably in a range of from about 1:5 to about 1:1. Thus, in an embodiment where the contact plate 14 has a thickness of 0.4 mm, the insulation layer 270 (comprised of a web) may have a thickness that is in a range of from about 0.04 mm to about 0.8 mm, more preferably in a range from about 0.08 mm to about 0.4 mm.

In the embodiments where the insulation layers 270, 272, 274, 276, 278 are webs (tapes) that are adhered to the support substrates 15, 135, 150, 202, 225 by adhesive, the webs form a part of the contact plates 14, the cutter plates 130, the holding plates 134, the cutter plates 196 and the holding plates 198, respectively. However, in the embodiments where the insulation layers 270, 272, 274, 276, 278 are separate plates or webs (without adhesive), they do not form a part of the contact plates 14, the cutter plates 130, the holding plates 134, the cutter plates 196 and the holding plates 198, respectively.

In those embodiments where the coupler 10, the IDT 122 and the IDT 190 have insulation layers 270, 272, 274, 276, 278, respectively, they may carry AC power having a frequency in a range of greater than 60 Hz to about 500 kHz and current in a range of from about 10 amps to about 100 amps.

It is to be understood that the description of the foregoing exemplary embodiment(s) is (are) intended to be only illustrative, rather than exhaustive. Those of ordinary skill will be able to make certain additions, deletions, and/or modifications to the embodiment(s) of the disclosed subject matter without departing from the spirit of the disclosure or its scope.

What is claimed is:

1. In combination, an electrical conductor and an electrical connector, the connector comprising:

a plurality of metal plates, each of the metal plates having opposing planar surfaces and comprising a pair of first legs separated by a first slot;

a plurality of insulation layers adjoining the planar surfaces of the metal plates, respectively, each of the insulation layers comprising a pair of second legs separated by a second slot;

wherein the metal plates and the insulation layers are arranged in a stack, the first and second slots being aligned to form a groove extending through the stack; and wherein the conductor is disposed in the groove of the connector to electrically connect together the metal plates.

2. The combination of claim 1, wherein the combination carries AC power having a frequency greater than 60 Hz.

3. The combination of claim 2, wherein the combination carries AC power having a frequency in a range of greater than 60 Hz to about 500 kHz and current in a range of from about 10 amps to about 100 amps.

4. The combination of claim 2, wherein the insulation layers are coatings adhered to the metal plates, and wherein each of the metal plates has at least one of its planar surfaces coated with one of the insulation layers.

5. The combination of claim 4, wherein each of the insulation layers is a coating formed from a material selected from the group consisting of a thermoplastic resin, a thermoset resin, glass, ceramic and glass-ceramic.

6. The combination of claim 5, wherein each of the insulation layers is a coating formed from one of an epoxy resin and polytetrafluoroethylene.

7. The combination of claim 4, wherein each of the metal plates has both of its planar surfaces coated with two of the insulating layers, respectively.

8. The combination of claim 4, wherein portions of interior edges of the metal plates are exposed and not covered by any of the polymer resin of the insulation layers.

9. The combination of claim 8, wherein the exposed interior edges make electrical contact with the conductor.

10. The combination of claim 1, wherein the insulation layers are polymer plates adjoining the metal plates, respectively.

11. The combination of claim 10, wherein the polymer plates are each comprised of an insulating plastic selected from the group consisting of polytetrafluoroethylene, polyethylene and nylon.

12. The combination of claim 1, wherein the insulation layers are webs adjoining the metal plates, respectively, and wherein each web is comprised of a material selected from the group consisting of cellulose paper, fishpaper, inorganic paper, non-cellulose polymer paper and polymer films.

13. The combination of claim 1, wherein the metal plates are movable relative to each other, and wherein the conductor is a bus bar with opposing planar surfaces.

14. The combination of claim 13, wherein the insulation layers are coatings adhered to the metal plates, and wherein each of the metal plates has at least one of its planar surfaces coated with one of the insulation layers, the metal plates coated with the insulation layers forming contact plates arranged in the stack;

wherein the connector further comprises a housing, within which the stack of the contact plates is held so as to be pivotably movable; and wherein each of the contact plates comprises a pair of elements having opposing first and second end portions, respectively, the elements being joined together, intermediate the first and second end portions, with the first end portions being separated by a first space and the second end portions being separated by a second space, the contact plates being arranged in the stack such that the first spaces are aligned to help form the groove.

15. The combination of claim 14, wherein the groove is a first receiving groove and wherein the contact plates are arranged in the stack such that the second spaces are aligned to help form a second receiving groove, the first and second receiving grooves being oppositely directed; and wherein the connector further comprises a mounting contact extending into the housing, the mounting contact comprising a plurality of fastening structures joined to and extending from a bar section, the bar section being disposed in the second receiving groove and the fastening structures being adapted for press-fit insertion into holes of a substrate.

16. The combination of claim 1, wherein the conductor is part of a wire that includes an outer insulating sheath disposed over the conductor, the wire being disposed in the groove;

wherein the metal plates are secured together in the stack; and wherein a plurality of the metal plates have cutting edges for disrupting the insulating sheath of the wire to permit the conductor to directly contact the metal plates.

17. The combination of claim 16, wherein the insulation layers are coatings adhered to the metal plates, and wherein each of the metal plates having a cutting edge has at least one of its planar surfaces coated with one of the insulation layers, the metal plates with cutting edges that are coated with the insulation layers form cutter plates arranged in the stack.

18. The combination of claim 17, wherein each of an outer pair of the metal plates has its planar surfaces coated with two of the insulation layers, respectively, the outer pair of the metal plates coated with the insulation layers forming holding plates;

wherein the cutter plates are disposed between the holding plates; and wherein the holding plates are more rigid than the cutter plates in a direction normal to the direction of the groove.

19. The combination of claim 18, wherein the cutter plates and the holding plates are secured together by welding.

20. The combination of claim 19, wherein at least one of the cutter plates has a fastening structure extending therefrom, the fastening structure being resiliently deformable for press-fit insertion into a hole of a substrate.

* * * * *